US005167301A

United States Patent [19]

Cappi et al.

[11] Patent Number: 5,167,301

[45] Date of Patent: Dec. 1, 1992

[54] SUPERMARKET CHECKOUT COUNTER INCORPORATING DUAL BAG FEEDING APPARATUS FOR DISPENSING, DELIVERING, OPENING AND RETAINING FLEXIBLE BAGS FOR PURCHASED ARTICLES

[75] Inventors: Angelo Cappi, Modena; Renato Rimondi, Bologna, both of Italy

[73] Assignee: A.W.A.X. Progettazione E Ricerca S.r.l., Vignola, Italy

[21] Appl. No.: 613,147

[22] Filed: Nov. 14, 1990

[30] Foreign Application Priority Data

Nov. 21, 1989 [IT] Italy ..... 22455 A/89

[51] Int. Cl.[5] ..... B65B 67/12

[52] U.S. Cl. ..... 186/66; 225/100; 53/567; 53/390

[58] Field of Search ..... 186/59, 61, 66; 225/100, 103; 53/567, 390, 391, 384.1

[56] References Cited

U.S. PATENT DOCUMENTS

| | | | |
|---|---|---|---|
| 2,902,811 | 9/1959 | Joyce . | |
| 3,025,651 | 3/1962 | Stanley | 186/66 X |
| 3,057,527 | 10/1962 | Hannon . | |
| 3,190,049 | 6/1965 | Van Der Meulen . | |
| 3,431,706 | 3/1969 | Stuck | 53/390 |
| 3,564,814 | 2/1971 | Graveley | 186/66 X |
| 3,626,662 | 12/1971 | Graveley | 186/66 X |
| 3,699,741 | 10/1972 | Norman . | |
| 3,740,922 | 6/1973 | Liou | 53/390 X |
| 3,754,370 | 8/1973 | Hanson . | |
| 3,792,565 | 2/1974 | Goransson . | |
| 3,942,694 | 3/1976 | Jones et al. . | |
| 4,070,951 | 1/1978 | Bala . | |
| 4,085,822 | 4/1978 | Osborn | 186/66 |
| 4,230,204 | 10/1980 | Langen et al. . | |
| 4,284,221 | 8/1981 | Nagel et al. | 225/100 |
| 4,306,633 | 12/1981 | Langen et a;. . | |
| 4,484,662 | 11/1984 | Busch | 186/66 |
| 4,493,684 | 1/1985 | Bolton | 225/100 X |
| 4,514,962 | 5/1985 | Ausnit . | |
| 4,651,506 | 3/1987 | Lerner et al. . | |
| 4,726,170 | 2/1988 | Sawa et al. . | |
| 4,730,762 | 3/1988 | Felix . | |
| 4,774,796 | 10/1988 | Aiuola et al. . | |
| 4,835,948 | 6/1989 | Humphrey | 53/567 |
| 4,909,356 | 3/1990 | Rimondi et al. | 186/66 X |

FOREIGN PATENT DOCUMENTS

| | | | |
|---|---|---|---|
| 0207838 | 1/1987 | European Pat. Off. . | |
| 0363335 | 4/1990 | European Pat. Off. | 186/66 |
| 2375097 | 7/1978 | France . | |
| 500095 | 1/1971 | Switzerland . | |
| 1509727 | 5/1978 | United Kingdom | 53/384 |
| 2055084 | 2/1981 | United Kingdom . | |

*Primary Examiner*—Michael S. Huppert
*Assistant Examiner*—William M. Hienz
*Attorney, Agent, or Firm*—Cohen, Pontani, Lieberman, Pavane

[57] ABSTRACT

A checkout counter for supermarkets and the like incorporates therewithin dual bag feeding apparatus, each operable for automatically dispensing, delivering, opening and retaining a flexible bag in a position and location suitable for the convenient introduction of purchased articles into the bags. The checkout counter includes two continuous web reels of successively attached flexible bags, two hoppers below each of which an open bag is retained and through each of which purchased articles are selectively insertable into the underlying bag as the articles are checked by the cashier-operator, and two collecting stations into which filled bags are ejected from the checkout counter interior and from which the customer may retrieve the filled bags. The operation of the two bag feeding apparatus are operatively controlled in a coordinated manner so as to optimize the time during which both of the hoppers are open for permitting the selective introduction of purchased articles into either of the two bags disposed in open condition therebelow.

19 Claims, 8 Drawing Sheets

SUPERMARKET CHECKOUT COUNTER INCORPORATING DUAL BAG FEEDING APPARATUS FOR DISPENSING, DELIVERING, OPENING AND RETAINING FLEXIBLE BAGS FOR PURCHASED ARTICLES

FIELD OF THE INVENTION

The present invention relates to check-out counters used in supermarkets and other points of sale and, more particularly, to a check-out counter integrally incorporating apparatus for dispensing and delivering, on request, plastic or otherwise flexible and nonelastic bags, and for opening and holding open the bags so as to permit either the cashier or the customer to conveniently introduce articles purchased by the customer into the open bags as the articles are checked out by the cashier.

BACKGROUND OF THE INVENTION

In current practice, items purchased or intended for purchase by a customer in a supermarket or like establishment or other point of sale are typically carried or transported by the customer, by hand or in a cart or other user-displaceable carrier, to a checkout counter or register at which a cashier attends to those operations necessary to suitably record the purchase. To this end the cashier generally takes up each item or article being purchased, one at a time, records the item price either by hand on a keypad or with the assistance of a bar code scanner or the like, and then immediately places each article on a conveyor belt or checkout counter surface or chute from which the articles can thereafter be bagged or packed for transport from the store, by the customer, after payment of the total charges for the customer's purchases. To pack the articles for such transport, the customer or cashier or other store employee manually grasps a bag from a typically stacked supply thereof and, after manipulating the bag open (and, if necessary, continuing to manually hold the bag in its open condition), individually picks up each article, in turn, from the conveyor or counter surface or chute and places the article into the open bag. When, after a time, the open bag becomes full, it is removed by hand to a remote location and another bag is likewise manually grasped, opened and positioned for the receipt of additional articles therewithin.

These operations consume an unnecessarily lengthy period of time and their slow and repetitive nature are among the major causes of customer-irritating congestion in supermarkets and the like where long lines of customers waiting to be processed through the checkout counters are today an extremely common sight. In an effort to reduce the inconvenience and delay to customers, the cashier may at times be assisted by another employee whose job it is to place the customer-selected articles into bags as the cashier records their purchase, thus minimizing distractions to the customer's attention during the article recording and payment steps and so that, once these operations are completed, the bags have been filled and are ready for the customer to transport from the store. The provision of a cashier's assistant, however, in addition to representing additional staffing costs to the supermarket, tends to prove unsatisfactory to the customer in that the assistant—in an effort to keep pace with the cashier's recording of the articles being purchased and thus bagging the articles in the same random order in which the cashier picks them up and passes them on—generally introduces the articles into the bags without regard to their type or other pertinent attributes and thereby notably increases the risk that the packed articles will be broken, squashed, polluted or otherwise damaged during subsequent transport of the filled bags.

OBJECTS AND SUMMARY OF THE INVENTION

It is accordingly an object of the present invention to provide a check-out counter constructed and operative for reducing delays in passing customers therethrough, and thus increasing the rate of customer flow through such checkout counters and the like without the need to employ cashier's assistants or additional personnel.

Another object of the present invention is to provide a checkout counter in which articles recorded by the cashier are selectively introducible into the bags in a manner so as to avoid or minimize breaking, squashing and other damage to packed articles during subsequent transport of the article-carrying bags.

A further object of the present invention is to provide a checkout counter for supermarkets wherein the items purchased by a customer may be selectively introduced, as they are checked by the cashier, into either of at least two separate bags—such for example by delineating one for foodstuffs and a second for other types of articles—so as to physically separate and segregate some types of articles from others being purchased and packed.

These and other objects are attained, in accordance with the invention, by a checkout counter for supermarkets and the like which is constructed so as to include two separate hoppers through which articles which have been checked or recorded at the counter may be introduced into bags, and two cooperatively controlled but substantially independently operable devices operable for automatically dispensing plastic bags from a continuous web supply thereof, for delivering the bags to an article-receiving station, for opening the bags and for maintaining the bags in their open condition at the receiving station for the ready receipt of articles directly from the cashier's hands as the articles are checked in the normal course of a checkout procedure.

Still additional objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

BRIEF DESCRIPTION OF THE DRAWINGS

In the drawings, wherein similar reference characters denote similar elements throughout the several views:

FIGS. 6A to 6D are end views, similar to FIGS. 5A to 5D, of the bag opening and retaining devices of the invention at four discrete times in the course of a bag opening operation;

FIGS. 7 to 9 are elevated perspective views of a modified form of a bag ejecting device of the inventive apparatus shown at three discrete time intervals.

DETAILED DESCRIPTION OF THE PREFERRED EMBODIMENTS

Figure 1:
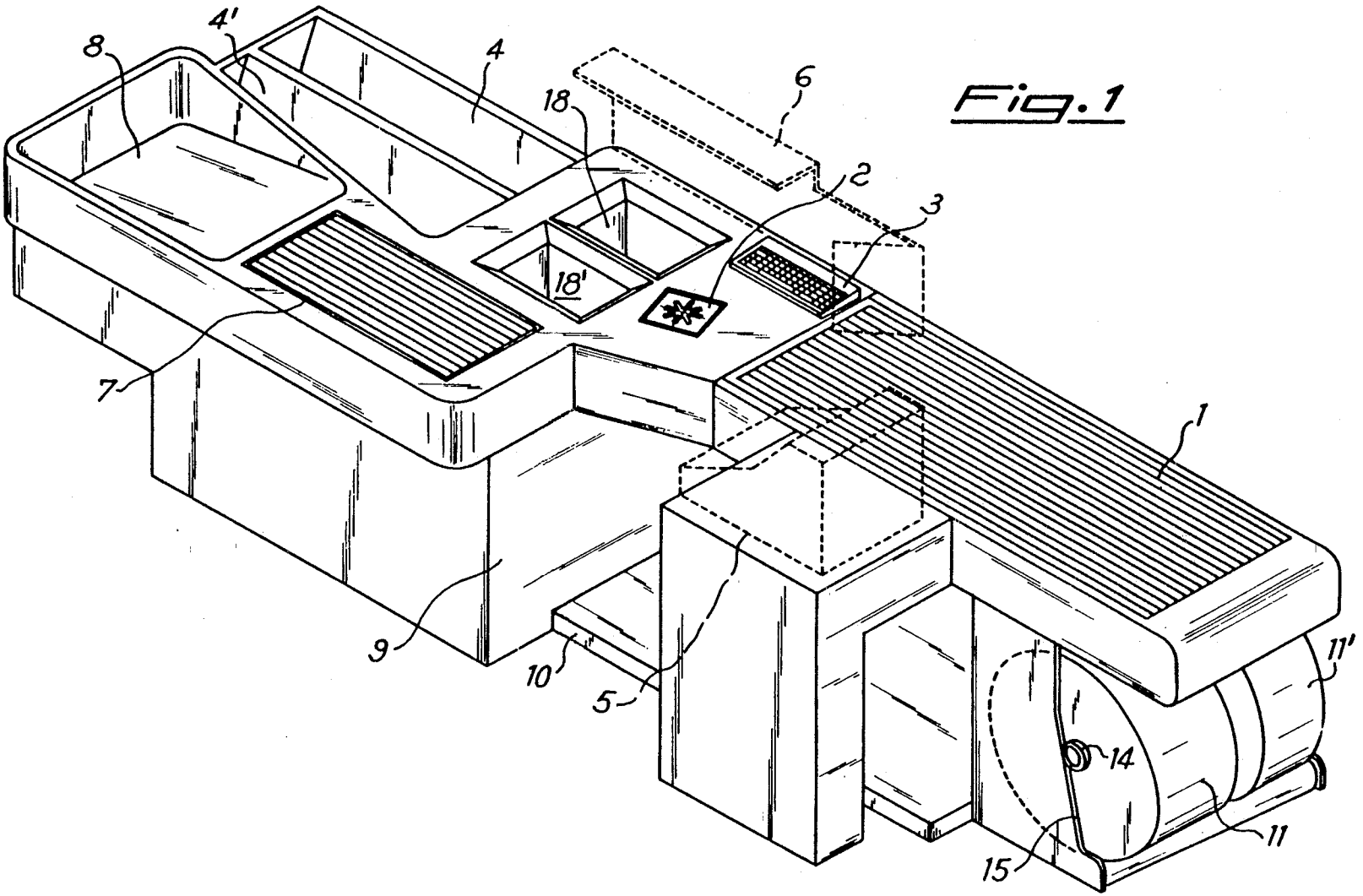
FIG. 1 is an elevated perspective view of a checkout counter constructed in accordance with the teachings of the present invention.

As should be apparent in FIG. 1, the checkout counter of the present invention is not, in outward appearance, notably different from traditional or otherwise known checkout counters. Among those elements common to conventional checkout counters, the inventive apparatus includes a plate or surface 1 on which the customer places items or articles that he or she has selected for purchase; an optional, but commonly-supplied, automated bar code scanner 2 for use by the cashier in identifying and recording the individual items being purchased; a keyboard 3 for manual entry of information on items not bearing a scannable bar code; a conveyor belt 7 upon which the cashier deposits checked or recorded items; a chute 8 from which the customer may pick up or withdraw purchased articles; and a checkout counter register 5 and safety guard 6, each represented by broken or phantom lines. Unlike conventional checkout counters, that of the present invention further includes two bag reels 11, 11' located beneath or below the plate 1, two hoppers 18, 18' through which checked items of normal size are directly introducible into plastic bags maintained in open condition therebelow, and collecting stations 4, 4' from which filled bags ejected from the checkout counter interior may be withdrawn by, for example, the customer. The bags are dispensed and delivered, in accordance with the invention and as described hereinafter, as needed from the reels 11, 11' and are automatically opened and held open as and for so long as they are being filled with purchased articles.

A recess 9 located at a central portion of the checkout counter defines the cashier's workplace. This arrangement places the cashier within easy reach of the scanner 2, keyboard 3 and register 5 and further enables the casher to readily select items from the plate 1 and introduce them into the hoppers 18, 18' or, if the items are too large or bulky to pass through the hoppers, to lay them down on the conveyor belt 7 for transport to the chute 8. The cashier may accordingly, after checking a particular item using either the scanner 2 or keyboard 3, use the same hand to immediately introduce it into either of the hoppers 18, 18' below each of which a bag, automatically fed thereto and opened and held open, is disposed in accordance with the present invention.

As the bags located under the hoppers 18, 18' become filled or, alternatively, there remain no additional items for introduction therein, the filled bags are transversely displaced or driven into the collecting stations 4, 4' from which they may be readily removed and transported from the store by the customer who will, in the meantime, have paid for the purchased and bagged items. It should be understood that the collecting stations 4, 4' are separate one from the other, so that bags containing those items introduced through hopper 18 and ejected into station 4 will not press against or abut those bags containing items introduced through hopper 18' and ejected into station 4'.

Thus, as should now be apparent the checkout counter of the invention is operatively effective for increasing the rates at which customers proceed through the checkout counter and procedure, and furthermore enables and greatly facilitates the direct selective sorting of purchased items as the items are checked by allowing them to be introduced into separate and distinct bags on the basis, by way of example, of whether or not they are foodstuffs, or fragile, or frozen, thereby minimizing or preventing the occurance of article breakage, squashing or like damage, or pollution during filling of the bags and/or their subsequent transport from the store or checkout counter location. Indeed, in accordance with the inventive apparatus the customer, after paying for the purchased items, need not then proceed to place them, either directly or indirectly, into the bags for transport; rather, the customer will find the purchased items already packed in bags in the collecting station 4, 4' since the filling of the bags takes place concurrently with the article-checking operations conventionally or otherwise carried out by the cashier. Moreover, during these same article-checking operations the cashier will have suitably sorted the items, conveniently and without delaying the checkout procedure, by inserting (for example) all foodstuffs or fragile or frozen articles into bags through one hopper and all stronger or otherwise differentiable articles into other, separate bags through the other hopper.

The bags employed in the checkout counter of the present invention may be and are generally contemplated as being of traditional or conventional construction, such as those formed of a substantially nonelastic and flexible plastic material and including a pair of top-disposed handles for facilitating customer transport of the filled bags. It is further contemplated that the bags 13 are provided in the form of a continuous strip or web in which individual bags are successively joined or linked one to another, the top of one to the bottom of the next, by a frangible connection such, for example, as perforations or the like. More particularly, two continuous strips or webs are wound about a central core 14 so as to define the reels 11, 11' although, as should be apparent, separate cores 14 for each of the reels may instead be advantageously employed so as to facilitate replacement of the individual reels 11, 11' as each is exhausted.

The ends of the central core 14 protrude laterally from the bag reels and rest against the inclined or sloping edges 15 of vertical walls that at least partially cover the sides of a housing for the reels 11, 11'. Upon actuation by the cashier, operative elements of the inventive checkout counter cause the continuous bag strips to unwind from the reels 11, 11' and to pass under the cashier platform 10, a single leading bag is detached or separated from each continuous strip, and each detached bag is automatically opened and held open under a respective one of the hoppers 18, 18' as it is filled with purchased articles introduced through the hopper. The filled bags are then automatically ejected or discharged from the checkout counter interior and are placed at the customer's disposal in the collecting stations 4, 4'. Both the structure and the operation of the various elements and devices incorporated in and forming the checkout counter of the invention will now be described in suitable detail with specific reference to the drawing Figures.

Figure 2:
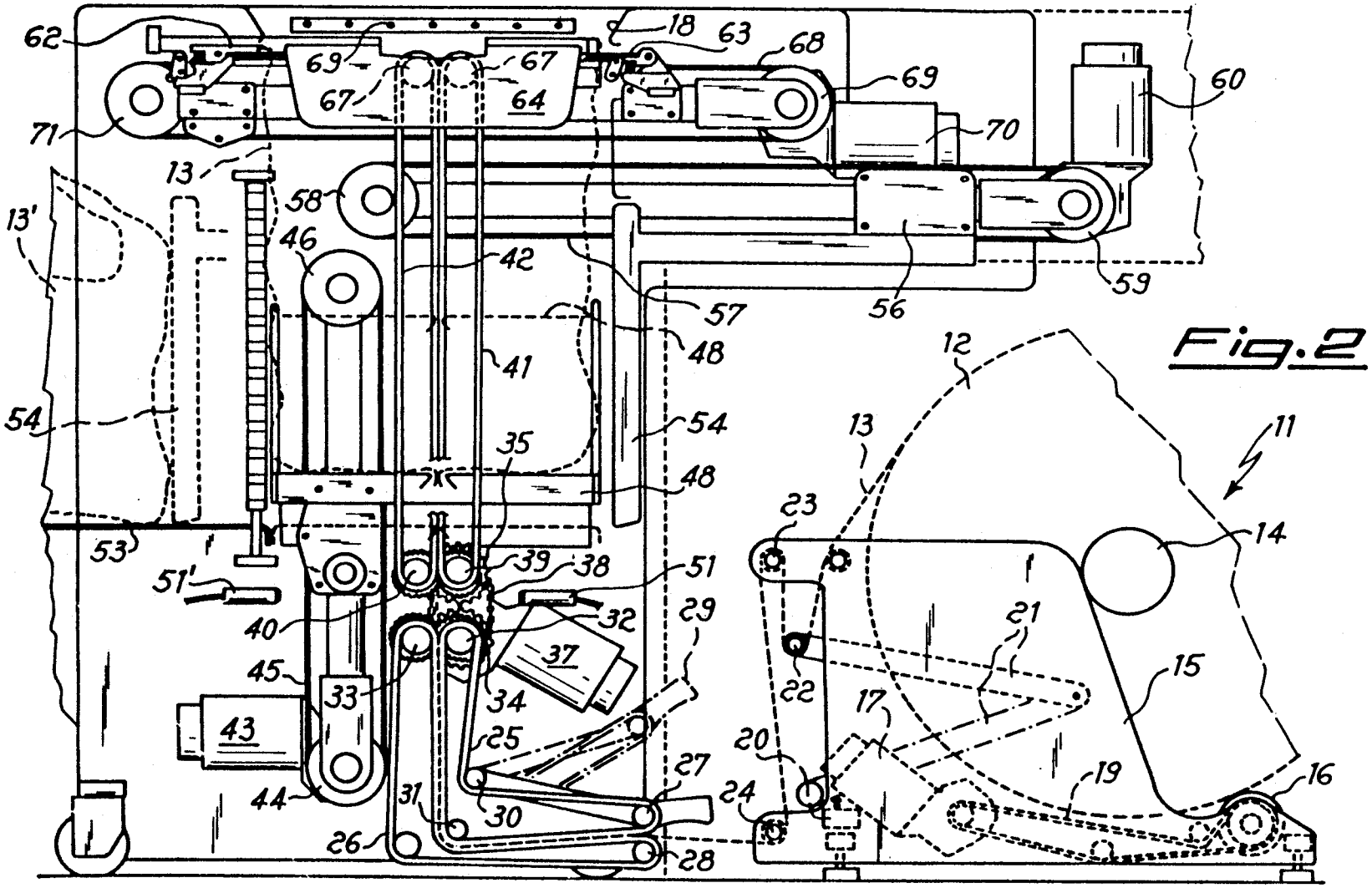
FIG. 2 is an elevated cross-sectional side view of certain interior parts of the checkout counter of the invention and showing the bag dispensing, delivering, opening and retaining devices thereof.

With initial reference to FIG. 2—which depicts one of the two substantially identical bag feeding apparatus formed of bag dispensing, delivering, opening and retaining devices that combinationally and cooperatively form the inventive checkout counter—the bag reel 11 is defined by a continuous strip 12 of longitudinally attached bags 13 wound about a central core 14. As previously pointed out, the ends of the central core protrude laterally from the sides of the reel 11 and rest on and against the sloping edges 15 of the housing cover side panels. The bottom of the reel is supported on a rubberized roller 16 that is rotatable by operation of a reduction motor 17, through a chain 19, to unwind the reel for feeding a bag into article-receiving position immediately below the hopper 18. Motor 17 is operable for rotating the roller 16 only, however, when the actuating element of a microswitch 20 is not depressed by the lower part or arm of a rocking lever 21.

The upper part or arm of the lever 21 carries, at its free end, a tensioning roller 22 about which the continuous strip or web 12 of bags 13 is partly trained. When it is desired to advance a bag 13 to the open hopper 18 to be there opened and held open for the receipt of articles therein, the cashier or other operator of the apparatus depresses a start switch or button (not shown) that actuates a reduction motor 37 for initiating a bag feeding operation of the bag dispensing means. The continuous web 12 is thereby advanced upwardly along its travel path, tensioning the web and upwardly displacing the tensioning roller 22 whereby the upper arm of the rocking lever 21 is raised. The lower arm of the lever 21, pivoting about its lowermost end, is thus also raised and moves out of depressing or actuating contact with the microswitch 20 whereby the motor 17 is actuated and the rubberized roller 16 is rotated to effect unwinding of the reel 11. Support of the central core 14 of the reel 11 by the housing panel inclined edges 15 assures that the reel remains continuously supported by the rubberized roller 16 that controls the selected unwinding of the web 12.

From the tensioning roller 22, the continuous web or strip 12 is guided about idler rollers 23, 24 that redirect the web into the entry nip defined between lower driving belt units 25, 26. Each of the belt units 25, 26 is formed of a plurality of substantially parallel, transversely adjacent flat belts arranged for contact with one of the opposed faces of the bags 13 that connectedly form the continuous web 12. The exact number of belts provided in each unit 25, 26 is determined in accordance with the range of bag and web sizes that the apparatus of the invention is intended to accomodate; in the embodiment herein described each unit 25, 26 incorporates nine such belts for contact with each bag over substantially the entire face width thereof. The driving belt units 25, 26 are cooperatively disposed and operated so as to act on the respectively opposite faces of the bags and thereby grip the bags for transport between the opposed belts.

The plural belts of the units 25, 26 rotate about respective lower rollers 27, 28 and driving rollers 32, 33. Roller 27 is connected to one end of a manually-displaceable lever 29 by which the roller 27 may be raised or otherwise moved away from the roller 28 to facilitate insertion of the web 12 between belts 25, 26 when, for example, replacing an exhausted reel 11. Such displacement of the lever 29—as indicated by the broken line depiction in FIG. 2—and roller 27 is effected about a fulcrum defined by a first interposed roller 30 about which the belts of the lower driving belt unit 25 are trained. The belts of both the first and second lower driving belt units 25, 26 are similarly trained about a second interposed roller 31 disposed relative to the lower rollers 27, 28 and the driving rollers 32, 33 so that the opposed belts of the units 25, 26 are maintained in close, surface-to-surface contact at that portion or elbow of their runs at which the initial, substantially horizontal feeding of the web 12 is shifted to a substantially vertical feed.

The belts of the opposed web transport units 25, 26 are driven by rotation of driving rollers 32, 33; in the disclosed arrangement, the roller 32 is directly rotated by the motor 37, and the roller 33 is linked to and for rotation with the roller 32 by a pair of toothed wheels respectively keyed or connected to the rollers. Roller 32 also carries a pinion 34 which, by way of a chain 38, is linked to a corresponding pinion 35 carried on an upper roller 39. The operative rotation of roller 32 is thus transferred to the upper roller 39 and, from there, to an adjacently-disposed upper roller 40 through the meshed engagement of a pair of toothed wheels respectively connected to the rollers 39, 40 in a manner analogous to the linking of the driving rollers 32, 33. The upper rollers 39, 40 form, in conjunction with idler rollers 66, 67 and a plurality of drive belts trained thereabout, the respective lower ends of two sets or pairs of opposed upper driving belt units 41, 42. Thus, the motor 37 operatively drives both of the rollers 32, 33 of the lower belt units 25, 26 and, through the linkage of chain 38, the upper rollers 39, 40 of the two upper belt units 41, 42.

The opposed belts of the lower units 25, 26 press against each other about the second interposed roller 31, gripping therebetween the continuous bag strip 12 so that, as the belts are thereby rotated, the web or strip is driven upwardly toward the superposed bag opening device. The opposed, rotating or moving belts of the upper belt units 41, 42 similarly grip therebetween the continuous web 12 which is advanced from the underlying dispensing device and further advance the web toward the bag opening device of the present invention.

Interposed between the bag dispensing device and the superposed opening device is a bag loading or delivery device. The loading device is comprised of a reduction motor 43 operable for rotating a drive pulley 44, an idler pulley 46, a cable 45 trained about the pulleys 44, 46, a slide 47 and a bag loading plate or platform 48 secured to the slide. The slide 47, and the bag loading platform secured thereto, are vertically movable as the motor driven rotation of the drive pulley 44 is imparted to and effects movement of the cable 45. The loading platform 48 is formed of two half-plates separated by a central aperture 49 through which empty bags are passable in their ascending motion as will hereinafter be apparent.

In operation, single or individual bags 13 are detached from the continuous web 12 by reversing the direction of rotation of the rollers 32, 33 and of the belts of the lower units 25, 26 thereby driven, while discontinuing and preventing further rotation of the rollers 39, 40. This operation—which is hereinafter described with specific reference to FIG. 3—is enabled by the provision of two freewheels 36, 36' keyed or mounted on the roller 39. Reversing of the rotative direction or sense of motor 37 and of the rollers 32, 33 is controlled by the opposed elements 51, 51' of a photocell array between which the continuous web 12 passes as the web is advanced by the lower and upper driving belt units. For this purpose, the web 12 may as previously noted advantageously comprise a continuous stream or succession of attached bags 13 wherein the bottom of each bag is joined to the upper ends of handles which are defined in the immediately adjacent or following or subsequent bag. The serially connected bags in and defining the continuous web have their tops leading their bottoms in the advancing direction of web movement. As was also pointed out hereinabove, the attachment of and between adjacently-disposed bags in the web may, for example, be by way of a perforation or other frangible joinder permitting ready separation of the leading bag from the web when oppositely-directed forces are applied across the perforation.

As a consequence of the preferred relative orientations of the adjacently-disposed and attached bags there is a periodic alternation of full and empty spaces along the web 12, the full zones comprising those areas of the web defining the article-receiving bodies of the bags and each empty zone consisting of the open area bounded by the two handles and upper edge of one bag and by the bottom or lower edge of the immediately adjacent attached bag. During the upward motion of web 12 between the units 41, 42, the opposed photocell array elements 51, 51' are alternately obscured or blocked by the full zones and cleared or unblocked or lit as the empty bag zones are advanced through the area between them. Thus, when the lower edge of a bag 13 in the continuous web 12—more particularly of the leading bag—crosses or advances beyond the photocell array line or position, the elements thereof are lit, initiating the inversion or reversal of the rotative direction of the motor 37 and, thereby, of the rollers 32, 33 of the respective lower driving belt units 25, 26. The belt units 25, 26 thereby downwardly drive or retract the continuous web 12 while, at the same time, the freewheel 36' is locked so as to prevent further rotation of the rollers 39, 40 whereby the most upwardly disposed or advanced or leading bag 13 of the web is maintained stationary between the opposed belt units 41, 42. This operation effects tearing of the two small strip portions that join the bottom of one bag 13 to the upper end of the handles of the following, adjacent bag of the continuous web 12 and thus results in the physical separation of the leading bag from the remainder of the web.

After the leading bag 13 has thus been detached from the web 12, the rotative direction of the motor 37 returns to its orginal sense—i.e. that preceding the reversal. The rollers 32, 33 and associated lower belt units 25, 26 thereby once again initiate the forward or upward advance of the web and the single, now-detached bag 13 is transported by the upper belt units 41, 42 to a position immediately under the hopper 18.

Having arrived at the hopper 18, the detached bag 13 is opened by the opening device of the inventive apparatus and takes on the general shape depicted in broken or phantom line in FIG. 2. The Figure also indicates, again in broken line, the uppermost position attainable by the two halves of the bag loading platform 48 upon which the bottom or effective bottom of each bag 13 is supported as the bag is filled; this represents the vertical position of the loading platform 48 at the beginning of the bag filling step. In this manner single items introduced into a bag 13 through the hopper 18 need not traverse an excessively long drop from the hopper to the bag bottom and the chances of such items violently bumping against or being otherwise transported into article-damaging or deforming contact with the platform-supported bottom of the bag are reduced.

When all or substantially all of the initially available interior volume of the platform-supported bag 13 has been filled with articles, the loading platform 48 descends to an intermediate position (FIG. 2) at which the bag 13 is subjected to a second filling step. At the conclusion of this second step—e.g. with the available bag volume once again filled—the loading platform descends further to its lowest position (also depicted by broken lines in FIG. 2) at which the platform 48 lies at the same height or level as an ejection plate 53. It should be noted that, in the herein disclosed form of the inventive apparatus, the difference in vertical height between the intermediate and lowest positions of the loading platform 48 is relatively small and is merely intended to cause the topmost articles contained in the bag to further descend below the hopper 18 and the bag opening device. This assures that these articles will not, undesirably, bump against or be otherwise brought into contact with the hopper 18 or the bag opening device as the filled bag 13' is ejected from the apparatus. Thus, no further filling or addition of articles to the bag 13 should take place once the platform 48 begins its descent from its intermediate position.

The filled bag 13' is next shifted or displaced, to the left in FIG. 2, slidably onto and along the ejection plate 53 by an ejector 54 that drives the bag toward and through an opening in the apparatus wall whereby the bag is discharged from the interior of the apparatus into the collecting station 4. The horizontally reciprocating motion of the ejector 54 is controlled by a slide 56 (FIG. 2) which is linked by a cable 57 to a driven pulley 59 directly rotated by a reduction motor 60 and an associated idler pulley 58. In the Figure, the solid line depiction of the ejector 54 illustrates the ejector's initial or rest position and the dotted lines indicate an intermediate position in the course of a bag discharge or ejection operation. In a preferred form of the invention the ejector 54 is displaceable for driving the filled bag sufficiently into the collecting station 4 to prevent the filled bag 13' from falling over or otherwise spilling its contents as the ejector is subsequently withdrawn.

The loading device of the inventive apparatus further includes a second photocell array 61 disposed immediately below the upper edge of the hopper 18. The photocell elements of this second array are effective to detect when articles introduced into a bag 13 have reached a predetermined maximum level and, should the photocell elements remain blocked or obscured at the end of the bag filling operation—i.e. when the loading platform 48 has descended from its intermediate to its lowest position—operation of the motor 60 for displacing the ejector 54 is prevented. This is effective to avoid subjection of an overfilled bag to displacing movement by the ejector in which damage to the bag and contained articles and potential jamming or damage to the bag opening device could occur. Once the excess articles contained in the bag have been removed, the photocell elements of the array 61 are unblocked or relit and cease to prevent operation of the motor 60, thus permitting the ejector 54 to horizontally discharge the filled bag from the apparatus interior and into the collecting station 4 along the ejection plate 43.

The bag opening device is formed of opposed and operatively-cooperating left and right pliers or grippers 62, 63, respectively, and a pair of tiltable flaps 64, 65 disposed substantially perpendicular to the grippers. As seen in FIG. 2, the grippers 62, 63 lie immediately below or inwardly of two opposite sides of the hopper 18, and the tiltable flaps 64, 65 lie just below or inwardly of the other two opposite sides of the hopper. The flaps 64, 65, are pivotally movable between a first or horizontal position and a substantially vertical second position. In the first position, when the device is stationary, the hopper is closed or obstructed by the flaps so as to prevent the passage of articles through the hopper when no bag 13 is suitably positioned for their receipt. In the second position, illustrated in broken lines in FIG. 2, the bag 13 is positioned for receiving articles and the hopper is thereby opened or nonobstructed so as to permit the introduction of articles therethrough and into the bag.

The grippers 62, 63 are actuated by a reduction motor 70 through a cable 68 and respective drive and idler pulleys 69, 71. One of the grippers is linked to the upper branch or leg or run of the cable 68 and the other to the lower branch thereof so that, under the driving action of cable 68, the grippers are movable between a first position of maximum separation, illustrated in FIG. 2, and a second or meeting position of overlapped adjacency located at or closely proximate the center line of the hopper 18. When the grippers 62, 63 so meet, they operatively grasp the top edges of the two opposite faces of a plastic bag 13 which is thereby opened when the grippers, in returning from their second to their first positions of spaced apart relation, carry with them the opposite bag faces firmly grasped by the grippers. Immediately after or substantially concurrently with the returning grippers 62, 63 reaching their first positions the flaps 64, 65 are pivoted or otherwise moved downward from their horizontal to their substantially vertical positions by action of a solenoid or electromagnetic actuator 72 (FIG. 3).

In their downwardly pivoted or substantially vertical or second position, the flaps 64, 65 extend into the interior of the bag 13, against or at least proximate the opposed bag walls or sides, and thereby maintain these opposed bag sides in suitably spaced apart relation so as to permit the introduction of articles into the bag interior. It is generally contemplated that, where the bag includes gussets or bellows or the like, the flaps 54, 55 maintain the spacing or separation of the gusset-bearing sides of the bag. In this position—i.e. with two opposed faces of the bag 3 firmly grasped by the respective grippers 62, 63 and the other two opposed bag faces held apart by the downwardly-extending flaps 64, 65—the bag is thus maintained in its fully open condition with a generally cross-sectionally rectangular opening located immediately below the hopper 18. The exact manner in which the bag opening device of the invention operates is described in greater detail, with particular reference to FIGS. 5A to 6D, below.

Figure 3:
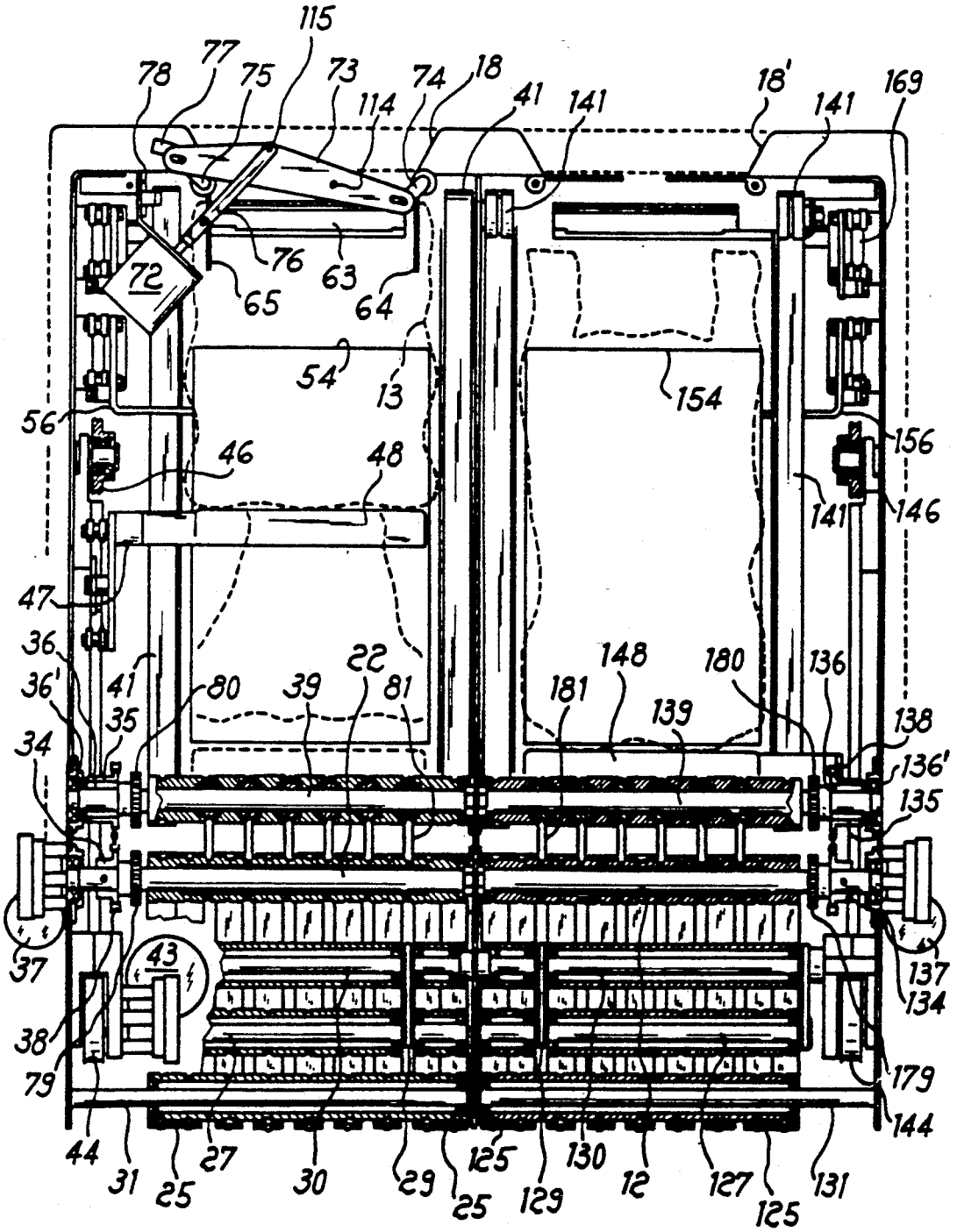
FIG. 3 is an elevated cross-sectional end view taken orthogonal to the side view of FIG. 2.

FIG. 3—which is an elevated end view orthogonal to that of FIG. 2 and seen from the downstream end of the checkout counter—depicts on the left that portion of the bag dispensing, delivering, opening and retaining devices of the invention which operatively transport a bag 13 to, and opens and holds open the bag in article-receiving position immediately under, the hopper 18. Seen on the right in FIG. 3 is the immediately adjacent, substantially parallel and analogous portion of the inventive apparatus that transports a bag 113 to, and opens and holds open the bag immediately in article-receiving position under, the hopper 18'. Each of these two corresponding bag feeding apparatus defines a substantially complete bag dispensing, delivering, opening and retaining unit, operatively disposed in side-by-side relationship within the interior of the same checkout counter. For clarity and ease of description, the parts and elements of the righthand (in FIG. 3) bag feeding apparatus are identified by the same reference numerals as the corresponding parts and elements of the lefthand bag feeding apparatus with, however, a preceding numeral "1" added thereto; thus, a bag 13 in the lefthand portion or apparatus corresponds to a bag 113 in the righthand portion, and the ejector 54 in the lefthand portion or apparatus corresponds to the ejector 154 in the righthand portion. Although for convenience the various parts and elements of only the bag feeding apparatus shown in the lefthand portion or half of FIG. 3 are expressly described, it should be understood that the corresponding righthand bag feeding apparatus is constructed and operates, except as otherwise specifically noted herein, in a substantially identical manner.

At the top lefthand side of FIG. 3, the gripper 63 is seen grasping the top portion of the bag 13 in its open position and the flaps 64, 65 are illustrated, in profile, in their downwardly or vertically-oriented dispositions spacing and holding apart the opposed sides of the bag. Pivoted movement of the flaps 64, 65 into their vertically-oriented positions in accordance with the operation of the solenoid 72 is effected by way of a rocking lever 73, one end of which is hingedly connected to a hub 74 of the flap 64 and the other end being hingedly connected to a hub 75 of the flap 65. The rocking lever 73 is further linked, at a location off-centeredly intermediate its ends, to the solenoid 72 by an arm 76. The end of rocking lever 73 most closely proximate solenoid 72 carries an extension 77 that, when the extension-carrying end of lever 73 is lowered under the action of a return spring (not shown), presses on a security sensor 78. Actuation or excitation of solenoid 72 drives arm 76 through an upward movement that causes a pivotal rotation of rocking lever 73 about its fulcrum 114, the ends of the rocking lever thus effecting clockwise and counterclockwise, respectively, rotations (as seen from the orientation of FIG. 3) of the hubs 75, 74. The hub rotations, in turn, drive the pivotal displacement of the attached flaps 65, 64 from their first, generally horizontal to their second, substantially vertical orientations. Additional particulars of the operation of these elements will be described hereinbelow.

Also seen in FIG. 3 is the upper half or portion of a bag 13 supported, at least in part, on the loading platform 48 for accomodating the introduction of articles into the bag. The lower end of the bag 13 hangs loosely down beyond the platform 48, extending through the aperture 49 that separates the two half-plates of the loading platform 48 and through which the bag passes in its ascension toward the superposed bag opening device.

The connection between the lower belt unit rollers 32, 33—by which the rotation directly imparted to roller 32 by motor 37 is transferred to roller 33—is implemented by the meshed engagement of a toothed wheel 79 on roller 32 and a correspondingly toothed wheel 79' keyed on roller 33. The driving roller 32 is additionally provided with a pinion 34 that is linked by chain 38 to a pinion 35 mounted on the upper roller 39. Chain 38, in conjunction with the pinions 34, 35, effects a transfer of the motor-driven rotary motion of roller 32 to the upper belt unit roller 39. The resulting rotation of roller 39 is, in turn, transferred to the adjacently-disposed roller 40 through the meshed engagement of a toothed wheel 80 on roller 39 with a like toothed wheel (not visible in FIG. 3) on roller 40. In this manner the opposed belts of the upper driving belt units 41, 42 are driven about the respective roller pairs 39, 66 and 40, 67 to carry upwardly or advance a bag 13 which is disposed between the belts into article-receiving position under the hopper 18.

The pinion 35 on roller 39 carries, as seen in FIG. 3, a freewheel 36 that permits rotation of the roller 39 in only a single sense—i.e. in the clockwise direction (in FIG. 2) by which a bag disposed between the belt units 41, 42 is upwardly advanceable. When the rotative direction of chain 38 is reversed by reverse rotation of the motor 37, the freewheel 36 idles, roller 39 is accordingly no longer driven and the web or bag-advancing motion of the upper belt units 41, 42 is discontinued. As previously pointed out, detachment of the leading bag 13 from the remainder of the web is effected by reversing the rotative direction of the opposed belts of the lower units 25, 26—between which the web is concurrently held or disposed—while the upper belt units 41, 42 between which the leading bag is grasped are maintained stationary. In order to assure that none of the withdrawing or downward or return movement of the web driven by the lower belts units 25, 26 is transferred or imparted to the upper belt units 41, 42 through the web which spans the lower and upper units, the roller 39 further carries a second freewheel 36'. The second freewheel 36' is arranged so as to idle freely as the roller 39 rotates in its (FIG. 2) clockwise sense for upwardly advancing a bag, but is locked against counterclockwise or oppositely-directed rotation of the roller 39. Thus, the second freewheel 36' is effective to prevent all counterclockwise (in FIG. 2) rotation of the roller 39 and, accordingly, all bag or web withdrawing motion of the upper belt units 41, 42—such, for example, as could otherwise occur as the web is withdrawn by the lower units 25, 26 during reverse rotation of the driving roller 32. The upper belt units 41, 42 are thus assured of remaining absolutely stationary during the detachment or separation of a leading bag 13 from the remainder of the web 12.

A plurality of relatively small, circular belts 81—six such belts are illustrated in FIG. 3—trained about the rollers 32, 39 are disposed in the free space between these rollers. The belts 81 provide suitable guidance for the web 12 in its transitional motion between the lower belt units 25, 26 and the superposed upper belt units 41, 42.

In a preferred form of the inventive apparatus, the two outermost ones of the plural belts forming each of the lower driving belt units 25, 26 are disposed in substantially edge-to-edge relation so as to define web-grasping regions of twice the width as that provided by the other belts located between the two outermost extremes of each belt unit. In FIG. 3, for example, may be seen a portion of the lower belt unit 25 in which five normally spaced-apart belts are located between two pairs of double-width or lateral edge-to-edge belts at the transverse sides of the unit. By virtue of this arrangement, enhanced dragging of the lateral portions of the web 12, at which are commonly disposed the handles of each single bag 13, is realized. The doubled width of the outer belt pairs is, preferably, substantially the same or at least as great as the width of the flattened handles of the bags 13.

In FIG. 3, the righthand half or part of the inventive apparatus is depicted at a different operative stage than the lefthand half or part; this is a consequence of and is intended to illustrate the predeterminately coordinated operation of the two parallel, adjacently-disposed bag feeding apparatus (each including bag dispensing, delivering, opening and retaining devices) of the inventive checkout counter. Thus, in the lefthand part or apparatus a bag 13 is shown in the first stage of being filled, i.e. with the platform 48 disposed at its initial or uppermost position (illustrated in phantom in FIG. 2). In the righthand part or apparatus as illustrated in FIG. 3, on the other hand, filling of a bag 113 has been completed and the platform 148 has descended to its lowermost position. In addition, ejector 148 has commenced, or is about to commence, its bag-discharging horizontal stroke (perpendicular to the plane of the drawing) to drive the filled bag 113 along the ejection plate 153 (not shown) and into the collecting station 4'.

Figure 4:
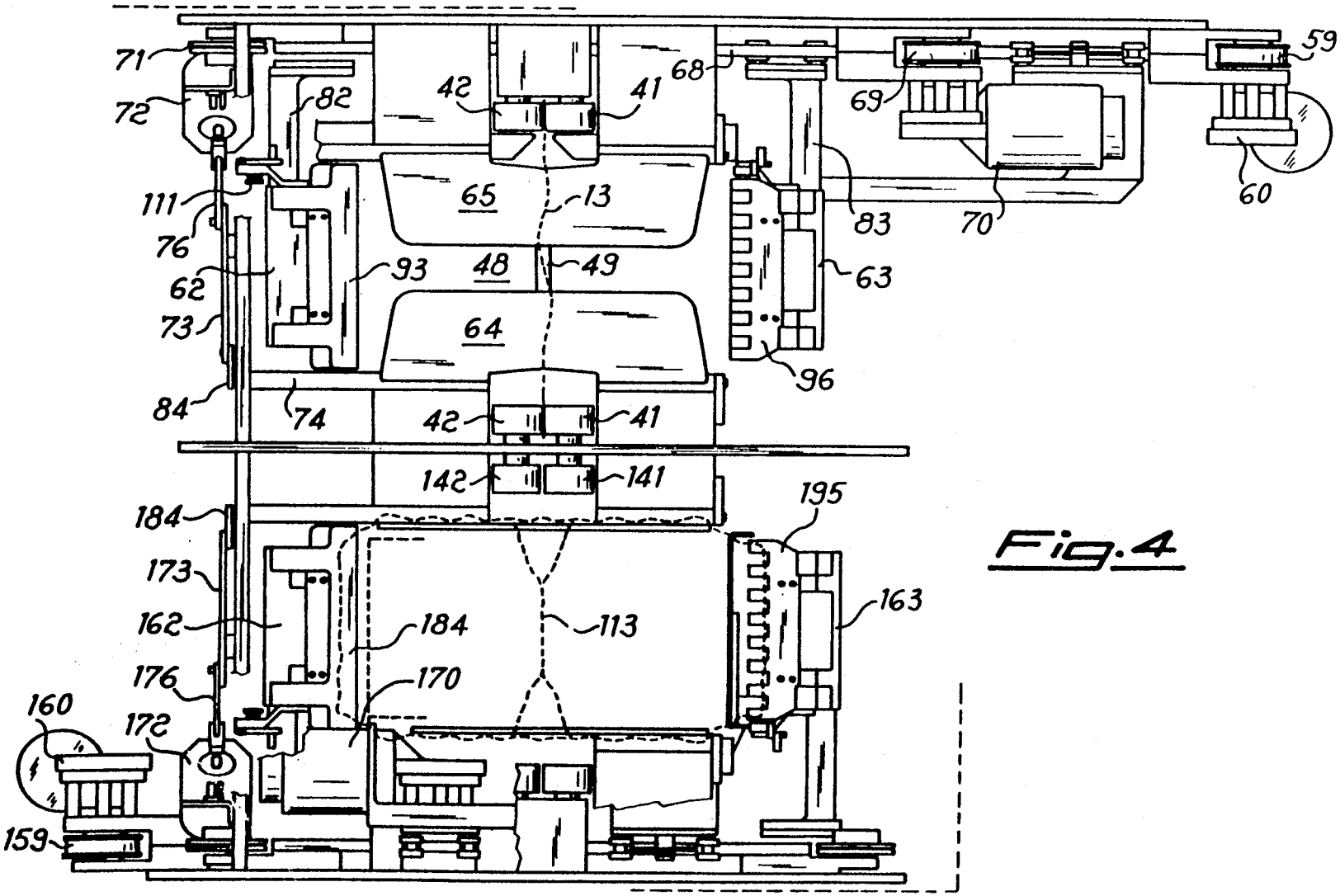
FIG. 4 is a top plan view of the bag dispensing, delivering, opening and retaining devices seen in FIGS. 2 and 3.

The hinged connections between the rocking lever 73 and the hubs 74, 75 which carry the pivotally displaceable or tiltable flaps 64, 65, respectively, are illustrated in the top plan view of FIG. 4. A small interposed lever 84 has one of its ends pivotally attached to an end of the rocking lever and its other end secured to the hub 74. A like lever (not shown, for clarity, in FIG. 4) is interposed between the opposite end of the rocking lever 73 and the hub 75.

With further reference to the top plan view of FIG. 4—and most particularly to that one of the two analogous operating assemblies or apparatus of the invention shown in the top half of the Figure—the motor is operable to rotate the drive pulley 69 and, thereby, the cable 68 trained about the drive and idler pulleys 69, 71. The gripper 62 is carried on a bracket 82 and the gripper 63 is carried on a bracket 83, each of the brackets 82, 83 being, in turn, secured to the cable 68 for movement therewith. The tiltable flaps 64, 65—here seen in their substantially horizontal orientations effective for preventing entry into the bag 13 of items inadvertently or prematurely introduced into the top of the hopper 18—are disposed substantially perpendicular to the grippers 62, 63. In the corresponding bag feeding apparatus illustrated in the bottom half of FIG. 4, the tiltable flaps 164, 165 are shown in their lowered or substantially vertical orientations in which the flaps do not block or constrict the hopper 18' and thereby permit the unencumbered introduction of purchased articles into the open bag 113.

Seen below the flaps 64, 65 in the upper half of FIG. 4 are the two half-plates of the loading platform 48, spaced apart by the central aperture 49 through which a bag 13 (depicted by the dotted lines) is upwardly advanceable by operation of the upper belt units 41, 42.

Figure 5A:
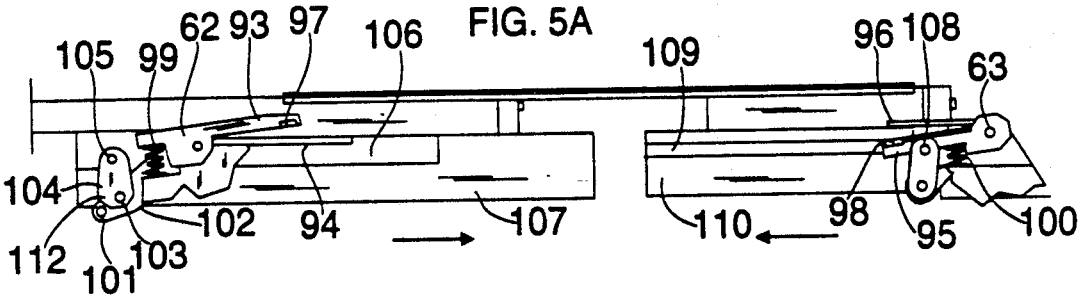
FIGS. 5A to 5D are side views successively illustrating the bag opening and retaining devices of the inventive apparatus at four discrete times in the course of a bag opening operation.

The top or upper part or arm 93 of the gripper 62 carries, on its lower face, a plurality of spaced apart rubberized blocks 97 (FIG. 5A). The lower part or arm 94 of the gripper 62 is configured to provide a series of recesses sized and shaped and spaced apart in accordance with the size, shape and spacing of the blocks 97 so that the blocks are movably receivable in and through the recesses. The gripper 63 is similarly formed of a lower part or arm 95 carrying, on its upper face, a plurality of spaced apart rubberized blocks 98 and a top or upper part or arm 96 configured, in the manner of the arm 94, to provide a series of recesses sized and shaped and spaced apart so that the blocks 98 are movably receivable in and through the recesses. Thus, the grippers 62, 63 are similarly constructed but are disposed or oriented in reverse or inverted or upside-down relation to each other—i.e. the top arm 93 of the gripper 62 is constructed in the manner of the lower arm 95 of the gripper 63, and the lower arm 94 of the gripper 62 is constructed in the manner of the upper arm 96 of the gripper 63.

In operation, the grippers 62, 63—carried on the motor-driven cable 68—advance until they meet and partly intermesh or interpenetrate so as to hold or grasp a bag 13 therebetween. More particularly, as the left and right (in the Figures) grippers 62, 63 are brought into intermeshed proximity the rubberized blocks 97 located on the lower surface of the left gripper upper arm 93 pass through the recesses of right gripper upper arm 96 until they abut left gripper lower arm 94, while the rubberized blocks 98 of the right gripper lower arm 95 abut the right gripper upper arm 96 after first passing through the recesses of the lower arm 94 of the left gripper 62.

Further details of the operation of the bag opening device of the invention, separated into four discrete steps for ease of discussion and understanding, are illustrated in FIGS. 5A to 5D and 6A to 6D; the former depict an elevated side view similar to FIG. 2 while the latter show an elevated end view similar to that of FIG. 3. In FIG. 5A, both grippers 62, 63 are in their initial or open positions and have just commenced, as indicated by the arrows, their mutual approach under the action of motor 70 by way of the cable 68. The upper arm 93 of left pliers 62 can be seen to be carrying thereunder the plural rubberized blocks 97 intended to provide improved gripping of the face of a bag 13 when the opposed arms 93, 94 of gripper 62 close with the bag held between the arms. The left gripper 62 is normally biased toward the closed position of its opposed arms by a spring 99 that urges the working or block-carrying end of the upper arm 93 toward lower arm 94; a spring 100 similarly urges the block-carrying end of the right gripper lower arm 95 toward the upper arm 96. It should also be pointed out that the grippers 62, 63, in addition to being oriented in reverse or inverted relation to each other, are relatively offset one to the other so that the rubberized blocks of each gripper are in appropriate register with the corresponding recesses of the other gripper.

Disposition of the left gripper 62 in its open position or state is effected by upward displacement of a small lever 102 in opposition to the urgency or resistance of the spring 99. The small lever 102 is pivotally movable about a fulcrum 103 on a further lever 104. A pin 105 protrudes from the upper portion of the lever 104 and is receivable in and slidable along a groove 106 defined in a guide member 107 fabricated, by way of example, of polyamidic material in the form of a parallelepiped. The groove 106 begins (at its left side in FIGS. 5A to 5D) with a sloped or tapering chute by which the pin 105, as the left gripper 62 is advanced toward the right gripper 63, is initially driven downwardly into the central, substantially horizontal, elongated portion of the groove 106. As the pin is thus lowered, it carries with it the lever 104 causing the small lever 102 to pivot about the fulcrum 103 and pivotally displace the upper arm 93 away from the lower arm 94 so that the gripper 62 is opened. The groove 106 terminates, at its rightward end, in an upwardly-directed, substantially vertical leg which, when traversed by the pin 105, permits the left gripper upper arm 93 to pivotally return to the gripper-closing position under the urgency of the spring 99.

In a similar arrangement, the working end of the right gripper lower arm 95 is displaced downward against the urgency of the spring 100 to open the gripper 63 as a pin 108 enters and moves along a groove 109 defined in a guide member 110 fabricated, by way of example, of polyamidic material in the form of a parallelepiped. As with the groove 106, the groove 109 begins (at its right-hand end in FIGS. 5A to 5D) with a downwardly sloped or tapered chute; unlike the groove 106, the groove 109 does not terminate with an upwardly-directed leg. The guide member 110 is, in the currently disclosed embodiment of the invention, shorter than the member 107 and, as a consequence, the pin 108 is able to simply exit the leftward or downstream end of the groove 109 under the urgency of the spring 100.

Figure 5B:
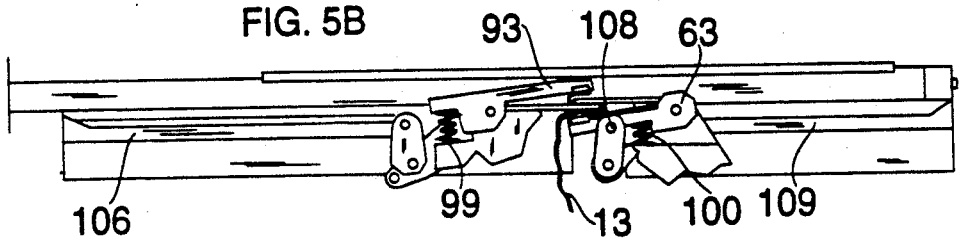

Illustrated in FIG. 5B is the step or time at which the left and right grippers 62, 63 meet and partially intermesh or interpenetrate, both horizontally and vertically, with a bag 13 interposed therebetween. In this position the bag 13 is held firmly between the left gripper blocks 97 and lower arm 94 on one side and the right gripper blocks 98 and upper arm 96 on the other. The movement of pin 105 along groove 106 has carried it to the vertical leg of the groove within which it may rise, under the urgency of spring 99, to cause the lifting of lever 102 and the resulting closure of the opposed left gripper arms 93, 94 about a portion of the interposed bag 13. In a similar manner pin 108, having by this time arrived at and cleared the (leftward) end of groove 109, is free to rise under the urgency of spring 100 whereby the opposed right gripper arms 95, 96 are closed so as to grip between them another portion of the interposed bag 13.

With both the left and right grippers 62, 63 closed, the bag 13 has three adjacent zigzag-folded portions defined between the grippers. The uppermost portion lies between the rubberized blocks 97 of the upper arm 93 of the left gripper 62 and the upper surface of the upper arm 96 of the right gripper 63. The intermediate or central portion lies between the lower surface of right gripper upper arm 96 and the upper surface of left gripper lower arm 94. Finally, the lowermost portion lies between the rubberized blocks 98 of the right gripper lower arm 95 and the lower surface of the left gripper lower arm 94.

By virtue of this arrangement, as the grippers 62, 63 are retracted from their FIG. 5B positions of mutual interpenetration, the left gripper blocks 97 slide along and within the recesses of the right gripper upper arm 96 and the right gripper blocks 98 slide along and within the recesses of the left gripper lower arm 94, whereby the grippers become gradually disengaged from each other. The aforementioned uppermost and lowermost fold-defined portions of the bag 13, which are in contact with the gripper-carried rubberized blocks 97, 98, respectively, are dragged by the blocks as the grippers move apart. Since each such bag portion is defined by the two superposed sheets which form the two opposed sides or faces of the bag 13, in practice the outer surface of each such sheet, being in contact with a respective one of the sets of rubberized blocks 97, 98, is firmly held by the blocks while the inner surface of each sheet is freely slidable on the inner surface of the other sheet. Where the bags 13 are fabricated, as is currently preferred, of a suitable nonelastic plastic material, such relative sliding of the inner sheet surfaces is further facilitated by the low friction coefficient of the plastic material. Thus, as the two grippers 62, 63 are withdrawn and move away from each other, they carry with them—preferably aided by the different coefficients of friction of the rubberized blocks 97, 98 and the bag material—the two opposite faces or sides of the bag 13 which is accordingly thereby opened.

Figure 5C:
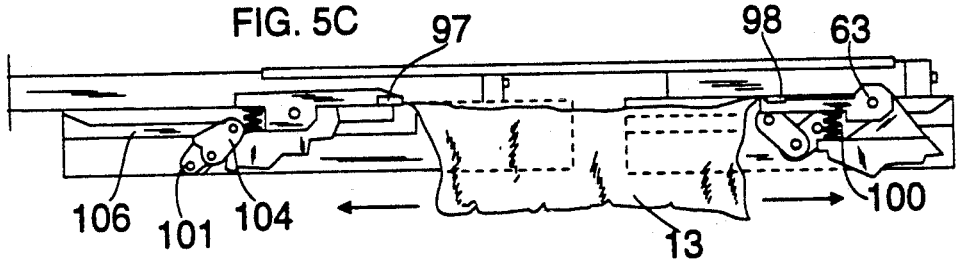

FIG. 5C depicts the grippers 62, 63 in the course of their mutual withdrawal from the FIG. 5B positions of cooperative interpenetration. The bag 13 is gradually opened by the moving apart of the grippers 62, 63 which, during such withdrawal, are both closed by the action of the respective springs 99, 100. During this return stroke the pin 105 slides within and along the groove 106 although the lever 104 is, at that time, in the illustrated inclined orientation under the urgency of a coil spring 111 (see FIG. 4) that hingedly and resiliently joins the small lever 102 to the lever 104. In this position an extension 112 of the lever 104 no longer engages a lock pin 101 of the small lever 102 and, as a consequence, the lever 104 remains in the inclined orientation seen in FIG. 5C. The operation of the right gripper 63 during the withdrawal or separation of the grippers is similar and should now be apparent.

Figure 5D:
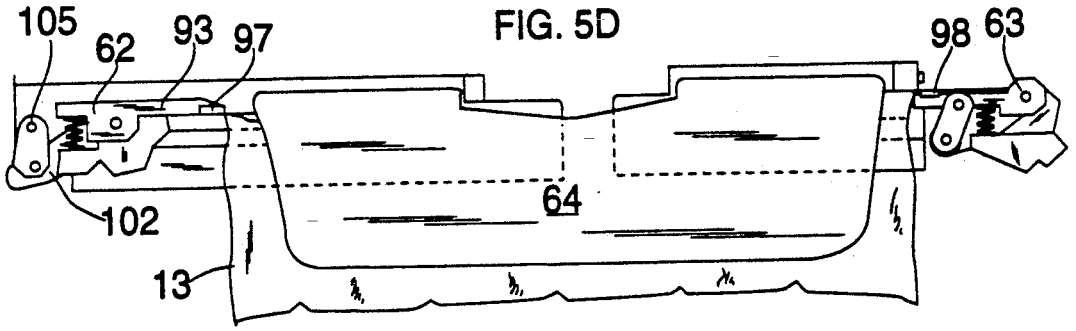

In FIG. 5D the grippers 62, 63 have reached their positions of maximum separation and, accordingly, the two faces of the bag 13 are likewise fully spaced apart. The pin 105, after arriving at the highest or most elevated part of the mouth of groove 106, has wholly disengaged from within the groove, thereby enabling the bias of spring 111 to restore the lever 104 to its vertical orientation in which its extension 112 is once again in surface-abutting engagement with the lock pin 101 of the small lever 102. In this position, when the pin 105 is subsequently driven into the groove 106 by the mutual approach of the left and right grippers 62, 63 to effect the opening of another bag 13, it will cause the lowering of the small lever 102 and the raising of left gripper upper arm 93 so as to open the gripper 62. At that time—presumably when the currently-grasped bag 13 has been suitably filled or packed with articles—the filled bag will become disengaged from the gripper 62, and likewise from the gripper 63, permitting its ejection or discharge from within the checkout counter of the invention.

Also shown in FIG. 5D is one of the flaps (64) that has been downwardly pivoted, thereby facilitating or effectuating the outward displacement of one of the bag sides defined between the two opposed faces which are grasped by the grippers 62, 63 and thereby assuring that the bag, as held below the hopper 18, is in its fully open condition for the receipt of articles to be bagged. In addition to outwardly displacing the bag side, the downward pivoting of the flap 64 is also effective to flatten the side gussets or bellows of the handle-incorporating bag 13. The flap 65, located at the opposite side of the bag opening device and not, therefore, visible in FIG. 5D, operates in the same manner as the flap 64 and performs like functions as to the opposite side of the bag. Thus, the bag opening and retaining devices of the invention, including the spaced apart grippers 62, 63 and the pivotable flaps 64, 65, are effective to maintain the bag 13 in its fully open condition with a mouth of substantially rectangular shape generally corresponding to the shape and size of the hopper 18 under which the bag is held for the smooth introduction and receipt of articles.

Figure 6A:
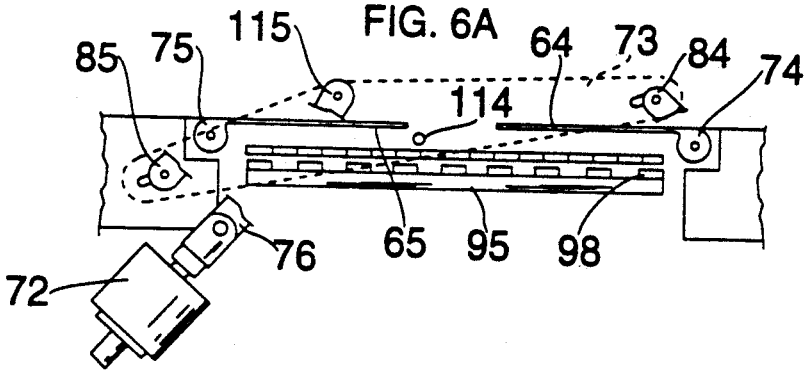

FIGS. 6A to 6D successively illustrate the pivotal movements of the flaps 64, 65. In FIG. 6A the flaps 64, 65 are seen in their horizontal positions also depicted in FIG. 4. In this initial position the flaps 64, 65 carry out their other function, namely that of avoiding the premature or accidental introduction of either hands or objects into a bag 13. The phantom lines in the Figure indicate the rocking lever 73; in actuality, the rocking lever is not disposed closely proximate the gripper 63 (as shown) but is, rather, closely proximate the gripper 62 (see FIG. 3), the so modified FIG. 6A depiction being solely for ease of description. In any event, the rocking lever 73 is oscillatable about its fulcrum 114 and is pivotally attached at pin 115 to the free or outbound end of the arm 76 of the solenoid 72. When the solenoid is not excited, the arm 76—under the urgency of a spring (not shown)—is shifted downwardly, thus lowering the pin 115 and, with it, that portion of the rocking lever 73 located to the left (in the Figure) of its fulcrum 114. This results in a downward rotation of a lever 85 pivotally joined at one end to the left end of lever 73 and secured at the other to the hub 75 of flap 65. The downward rotation of lever 85 effects a counterclockwise rotation of hub 75 whereby flap 65 is pivoted to its horizontal position shown in FIG. 6A.

As the left-shown side or end or arm of the rocking lever 73 is lowered about the fulcrum 114, the right side or end or arm is correspondingly pivoted upward. This carries with it an upward rotation of the lever 84 which has one end pivotally joined to the right end of rocking lever 73 and the other secured to the hub 74 of flap 64. The upward rotation of lever 84 causes a clockwise rotation of hub 84 by which the flap 64 is carried into the horizontal orientation seen in FIG. 6A.

Figure 6B:
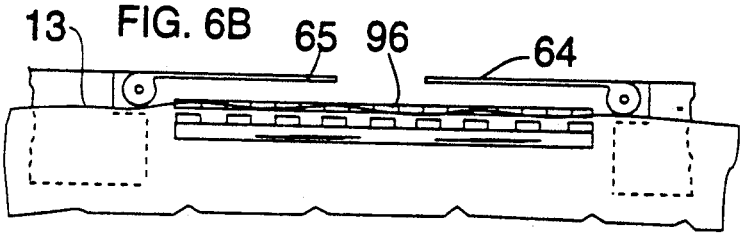
Figure 6C:
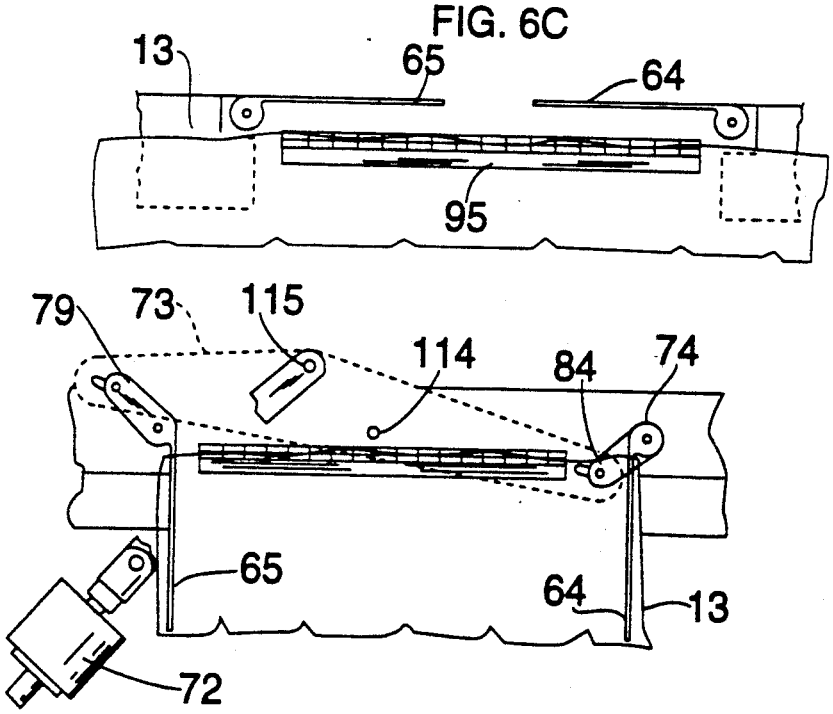
Figure 5:
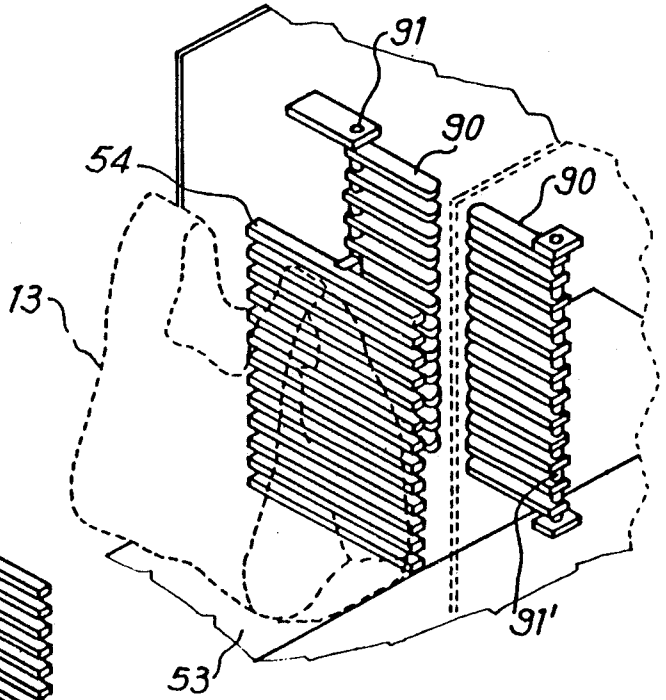

As indicated in FIGS. 6B and 6C, during the mutual interpenetration and subsequent withdrawal of the grippers 62, 63 the pivotable flaps 64, 65 are maintained in their horizontal positions blocking the introduction of articles, through the hopper 18, into the underlying open bag support region of the apparatus. With the flaps 64, 65 thus disposed, the extension 77 (FIG. 3) of the rocking lever 73 presses against the security sensor or switch 78 and any inwardly-directed pivotal movement of either flap—either accidentally or through the intentional placement of pressure on one of the flaps—releases and thereby actuates the sensor 78 and causes the apparatus to immediately discontinue all operations.

When the solenoid 72 is subsequently energized (FIG. 6D), the arm 76 is upwardly shifted, raising the pin 115 and causing a rotation of the rocking lever 73 about its fulcrum 114. In so rotating, the left end (in the Figures) of lever 73 rises, correspondingly raising the pivotally attached end of lever 85. The hub 75, connected to the opposite end of lever 85, is in turn rotated in the clockwise sense and the attached flap 65 is downwardly pivoted or tilted.

The upward shifting of arm 76 upon energizing of the solenoid 72 also causes a lowering of the righthand end of the rocking lever 73 to which one end of the lever 84 is pivotally secured. This lowering of the lever 84 drives the hub 74 (to which the opposite end of lever 84 is attached), and the flap 64 secured to the hub, through a counterclockwise rotation by which the flap is downwardly pivoted as shown in FIG. 6D. Downward pivoting or tilting of the flaps 64, 65 permits ready access of articles through the hopper 18 to a bag 13 held open immediately below the hopper by the bag opening device of the invention and, in addition, facilitates maintenance of the bag in its open condition by spacing apart the handles and upper portion of the bellows or folds of the open bag.

Figure 9:
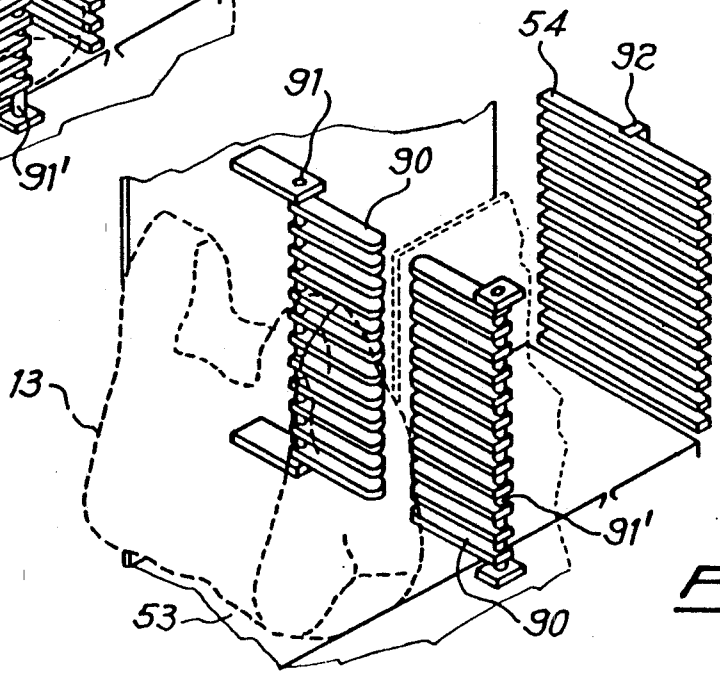
Figure 7:
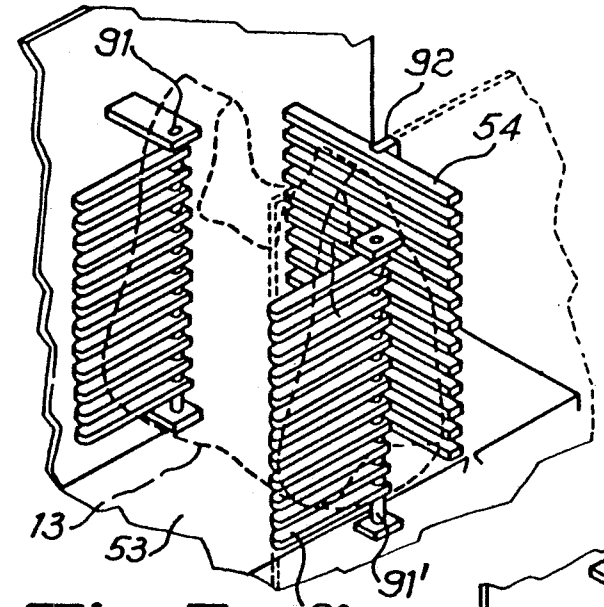

FIGS. 7 to 9 illustrate a preferred variation of the filled bag ejection device of the present invention. This variation provides, inter alia, enhanced safety features and includes a small gate 90 for closing off the area or space immediately above the ejection plate 53 so that the plate 53 remains clear for the free and unobstructed passage therealong of the ejector 54 and of a filled bag 13' driven by the ejector. The gate 90 also prevents a filled bag, already discharged from the apparatus interior by the ejector 54, from falling over or otherwise tilting backward on the ejection plate 53 and thereby obstructing the passage of a subsequent filled bag along the plate. The gate 90 is formed by a pair of doors pivotally mounted on spaced apart hinge-defining posts 91, 91', each of the doors consisting of a plurality of substantially parallel and horizontally oriented comb-like pickets.

The filled bag ejector 54 is similarly constructed of a plurality of substantially parallel and horizontally oriented, spaced apart pickets such as those of which the gate 90 is formed. The ejector pickets are mounted one above the next along the length of a vertical pin 92 sized for free passage through a gap defined between the two doors of the gate 90 when the gate doors are disposed in their closed (i.e. FIG. 9) position. The ejector 54 is furthermore located—and the spacings or gaps between adjacently-disposed pickets of each of the gate 90 and the ejector 54 are dimensioned—so that the ejector pickets are level or aligned with the gaps between the gate pickets. By virtue of this arrangement, when motor-driven movement of the filled bag ejector 54 carries it across the fixed position of the gate 90, it is free to pass outwardly beyond that position since the pin 92 is movable through the gap defined between the closed doors of the gate 90 and the ejector pickets are movable through the gaps defined between the adjacently-disposed gate door pickets.

FIG. 7 depicts the ejector 54 as it drives before it a bag 13—represented by the phantom lines in the drawing—along the ejection plate 53. It should be recognized that, as the thus driven bag abuts the gate doors, the doors swing or otherwise pivot open about the posts 91, 91' under the ejector-driven force of the bag. In FIG. 8 the bag 13, and the ejector 54, has passed through and beyond the gate 90 and the gate doors have returned to their closed positions under, for example, the urgency of return springs (not shown) which act upon the hinge-defining posts 91, 91'. FIG. 9 illustrates a later condition or step in which the ejector 54 is returning to its starting position after having passed freely through the closed gate doors. As seen in FIG. 9, the filled bag 13 is prevented from tilting or falling backward on the ejection plate 53 because of the presence of gate 90, the doors of which are pivotable to open the gate only in the ejection direction of a bag. In addition, the return springs are effective to normally maintain the gate 90 in its closed condition and thereby prevent both accidental and intentional introductions of, for example, customer limbs and other objects into the interior of the apparatus during its operation.

Another particularly advantageous and presently contemplated modification to the embodiment hereinabove described and illustrated in the drawings relates to the configuration of the collecting stations 4, 4'. In accordance with such a modification, both the partition wall separating the two adjacently-disposed stations 4, 4' and the opposed side wall of one of the stations—by way of example of the station 4'—are outwardly or otherwise inclined. By virtue of this arrangement the filled bags 13, 113 that are discharged or delivered from the checkout counter interior by the respective ejector 54, 154 slide along the respective ejection plate 53, 153 in an inclined orientation—i.e. angularly leaning with one side of the bags supported on the inclined wall of the collecting station. The bags 13, 113 are thereby prevented from unintendedly tilting and spilling their contents; indeed, the bags are notably steadier and more stable since they rest against and are supported not only by their bottoms on the ejection plates 53, 153 but, in addition, by one of their sides on either the inclined partition wall or the inclined opposite or outer wall of the collecting station.

The general operation of the checkout counter of the invention will now be described. Prior to the beginning of an operating shift, both bag feeding apparatus—i.e. each of the two such apparatus similarly incorporating bag dispensing, delivering, opening and retaining devices for automatically positioning an open bag immediately below a respective one of the hoppers through which purchased articles may be selectively introduced into the bag—of the checkout counter are stationary and the flaps 64, 65 and 164, 165 are disposed in their horizontal orientations in which they obstruct the passage of articles into the checkout counter interior through the hoppers 18, 18'. When the cashier or checkout counter operator starts a shift, he or she actuates the main checkout counter switch (not shown), thereby actuating a microprocessor that coordinates the operations of the two bag feeding apparatus incorporated within the checkout counter and which, at this stage, controls their resynchronization. In initiating this resynchronization the motors 17, 117 and 37, 137 of the two bag feeding apparatus are actuated. The resulting rotation of the rollers 16, 116 effects an unwinding movement of the reels 11, 11' whereby the leading bags 13, 113, each still attached to the remainder of the respective continuous web 12, 112, are driven upwardly first by the lower belt units 25, 26 and 125, 126 and, from there, by the small round belts 81 and 181 (FIG. 3). As the bottom edge of each leading bag 13, 13' passes the respective photoelectric array elements 51, 51' and 151, 151', the photocell elements are no longer obscured by the bag and trigger a reversal in the rotative direction of the motors 37, 137 and a consequent reversal in the rotational direction of the rollers 32, 33 and 132, 133 and of the roller-driven belts of the lower belt units 25, 26 and 125, 126. At the same time, the freewheels 36, 36' and 136, 136' are effective to prevent further web-carrying movement of the belts of the upper belt units 41, 42 and 141, 142. The reverse movement of the lower driving unit belts and the concurrent cessation of movement of the upper driving unit belts causes a single bag 13, 113—i.e. the leading bag—to be, for example, frangibly detached from the remainder of the continuous web 12, 112. Each detached bag 13, 113 is then advanced by the respective upper belt units 41, 42 and 141, 142 to a position immediately below the mouth of the corresponding hopper 18, 18' to be there opened and held open for the receipt therein of articles to be packed.

With the bags 13, 113 thus located immediately below the hoppers 18, 18', the two grippers 62, 63 and 162, 163 of each set thereof move simultaneously from their FIG. 5A positions toward the substantial centerline of the respective hopper 18, 18' (FIG. 5B) at which they mutually intermesh or interpenetrate, as heretofore described, and grasp the two opposite faces of the bag 13, 113. The grippers are then retracted to their original positions, driven by the motors 70, 170, thereby opening the bag. Upon the return of the grippers to their positions of maximum separation, the flaps 64, 65 and 164, 165 are downwardly pivoted, thus providing free and unencumbered access to the bags 13, 113 through the hoppers 18, 18' and maintaining the bag sides in spaced apart relation during the filling of the bag with purchased articles.

By the point at which the bags 13, 113 have been opened and the flaps 64, 65 and 164, 165 have been downwardly pivoted into their substantially vertical orientations, the motors 43, 143 have driven the loading platforms 48, 148 to their highest or uppermost positions for supporting the bags 13, 113 during the initial introduction of articles into the bag. At this position each of the bags 13, 113 is supported on the respective loading platform not by the bag bottom but, rather, by an area of the bag located (by way of example) slightly above the middle thereof (see, for example, the lefthand portion of FIG. 3). As should be evident from FIG. 3, in this first position of the platforms 48, 148 approximately the lower half of each bag, including its bottom, hangs loosely downward through the aperture 49, 149 defined between the two half-plates of the respective loading platform 48, 148.

The cashier may then selectively introduce articles, through the hoppers 18, 18', into the upper half of the supported bags 13, 113 until the level of the packed articles reaches and obstructs, or is at least proximate, the photocell array 61 or 161. Should there yet remain additional articles to be bagged, the cashier depresses the starting pushbutton of one or both bag (as necessary) feeding apparatus, thereby reactivating the respective motor(s) 43, 143 which lower the loading platform(s) 48, 148 to a position immediately below the bottom of the respective bag 13, 113 so that the bag remains fully supported for that additional time required to complete the filling thereof. Additional articles can then be introduced into the respective bag 13, 113 through the hopper 18, 18' until either the articles to be packed have been exhausted or the uppermost level of articles contained in the bag once more blocks or obscures the photocell array 61, 161.

With the bag 13, 113 thus containing either all remaining articles to be packed or its maximum volume of such articles, the cashier once more depresses one or both of the starting pushbuttons. This initiates a further and final descent of the loading platform(s) 48, 148 by an amount at least as great as the overall vertical dimensions of the opening device and, in any event, sufficient to assure that the top of the bag will not interfere with or unintendedly engage any interior parts or elements of the apparatus as the bag is subsequently ejected therefrom. Thus, by virtue of this final descent of the loading platform 48, 148, the top of the bag 13, 113—and more particularly the topmost level of articles contained in the bag—is brought below the opening device. The filled bag 13', 113' is now accordingly prepared for lateral ejection from the interior of the checkout counter, without interference, after its release by the grippers 62, 63 or 162, 163.

If, prior to the final descent of the loading platforms 48, 148, one or both of the photocell arrays 61, 161 remain obscured by articles contained in the bags 13, 113, the motors 43, 60, 70 and/or 143, 160, 170 are deactivated thereby preventing further driven movement of the loading plates 48, 148, grippers 62, 63 and 162, 163, and ejectors 54, 154. When all excess articles have thereafter been removed from the bag, the appropriate starting pushbutton is once more depressed and, assuming that the photocell array 61, 161 is no longer blocked by bagged articles, the motor 43, 143 lowers the loading platform 48, 148 to a height substantially even with the ejection plate 53, 153 and the respective motor 60, 160 drives the ejector 54, 154 to slidably transport the filled bag—already released by the grippers 62, 63 or 162, 163—along the ejection plate and into the corresponding collecting station 4, 4'. The customer may then grasp the filled bag 13', 113', as by its integral handles, and remove it from the collecting station. If there still remain additional articles to be packed in bags, the cashier once more depresses the starting pushbutton(s) of one or both bag feeding devices, and thereby initiates a new operating cycle of the inventive apparatus.

The operations of the two sets of bag dispensing, delivering, opening and retaining devices and associated elements of the apparatus, as well as the overall operation of the checkout counter as a whole, are coordinated and controlled by a control system that may, for example, advantageously incorporate or comprise a conventional microprocessor or the like. Such control system may be implemented in any suitable manner and as a matter of design choice by those of ordinary skill in the art and, accordingly, no further detailed description thereof is deemed necessary to enable the contemplated and intended practice of the invention.

Coordination of the operations of the two bag feeding apparatus of and which are incorporated within the checkout counter of the present invention, on the other hand, requires a suitable control program specially prepared to satisfy customer and operator requirements and anticipated contingencies in normal use of the invention. Indeed, it is an important feature of the invention that, in the operation of the checkout counter, the times during which the two hoppers 18, 18' are concurrently closed, to thereby prevent the introduction of articles into open bags positioned therebelow, be absolutely minimized or, if possible, substantially eliminated. This intention may be effectuated by so coordinating the operation of the checkout counter that one hopper can be closed only when the other is open so that, at all times during a checkout procedure, at least one open bag is always available for the receipt of purchased articles as the articles are handled and recorded by the cashier. It is also intended that the two hoppers be concurrently open during at least one-half of an operative cycle. Of still further importance is that each of the two corresponding bag filling apparatus be independently operable so that, should one of the apparatus become inoperable—even briefly as, for example, an exhausted reel 11, 11' is being replaced—the other bag feeding apparatus will continue to operate and thereby enable the cashier to continue to process customers and the articles being purchased through the checkout counter.

Figure 10:
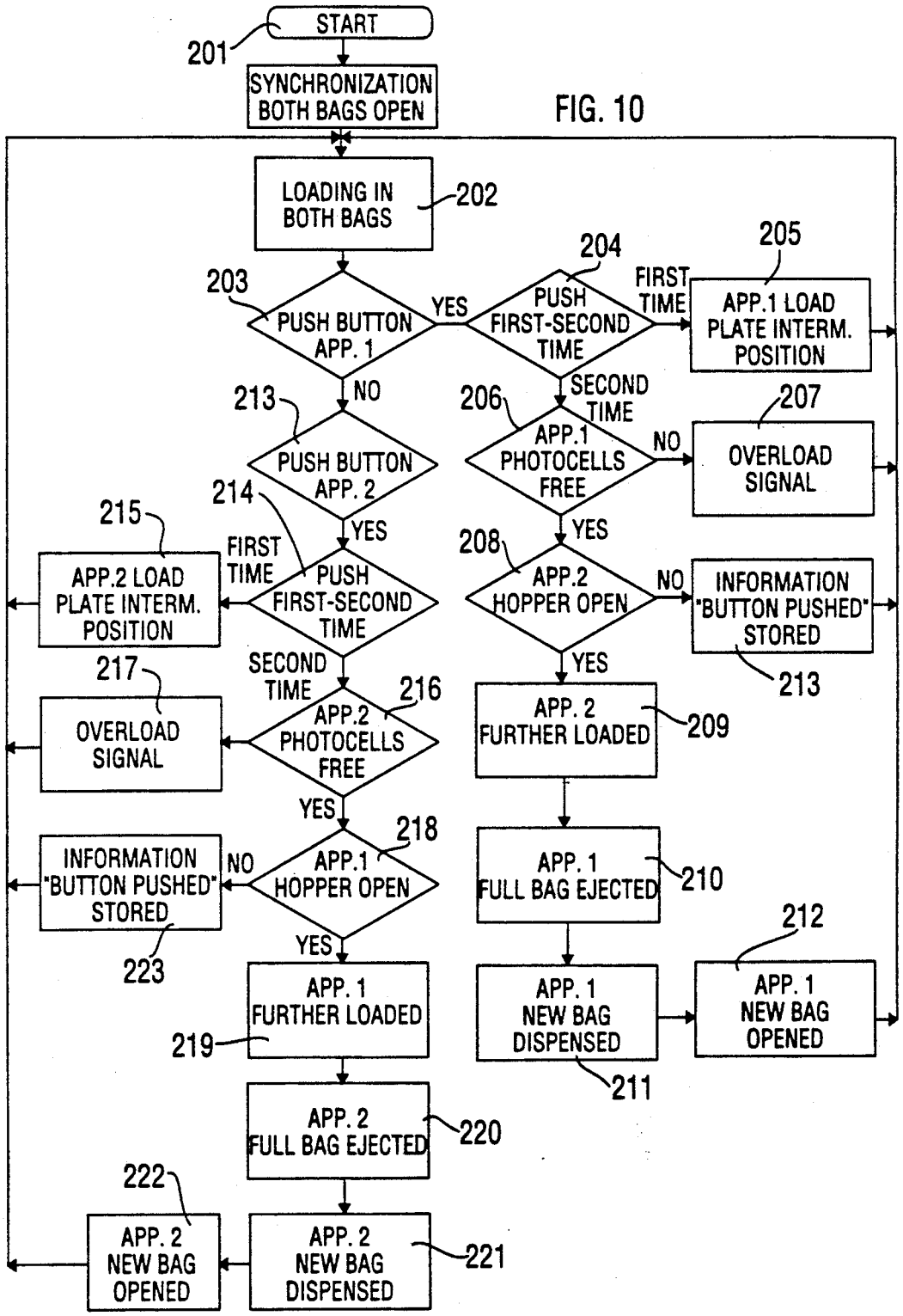
FIG. 10 is a flow chart which depicts the cooperative interaction and operation of the dual bag dispensing, delivering, opening and retaining devices of the checkout counter of the present invention.

The coordinated operations of the two corresponding or parallel bag feeding apparatus incorporated within the checkout counter of the present invention will now be described with specific reference to the flow chart of FIG. 10. In this chart the term "START" denotes that moment at which the checkout counter first becomes operative—i.e. the unit is turned "on"—when, for example, the store opens, and operation of both the first and the second bag feeding apparatus (hereinafter sometimes referred to as the "first apparatus" and the "second apparatus") commences. On startup, the checkout counter and all of its various operating devices, elements and parts are automatically synchronized at step 201; bags 13, 113 are delivered to, and opened and retained immediately beneath, the respective hoppers 18, 18' which are opened to enable the introduction of purchased articles through the hoppers and into the open bags as the articles are checked by the counter-attending cashier. The bags are thereby positioned for the receipt of purchased articles, the packing or loading of articles into the bags through the hoppers being indicated at step 202. It is preferred, and generally contemplated, that in introducing the articles into the bags the cashier will sort them in accordance with their type or nature or pertinent attributes such, for example, as by placing foodstuffs into the open bag 13 and non-foodstuffs into the open bag 113.

On noting that the initially available volume of one of the bags—as by way of example that designated by the reference numeral 13 and disposed immediately beneath the hopper 18 of the first apparatus—has been filled with purchased articles, the cashier depresses the starting pushbutton of the first apparatus (step 203), passing thus to step 204 and, since this is the first time that the pushbutton has been depressed in this operating cycle, advancing to step 205 in which the loading platform 48 of the first apparatus is lowered to its intermediate position (seen in the lefthand half of FIG. 3). Additional article-receiving volume is thereby provided within the bag 13 and, returning to step 202, articles can continue to be introduced thereto through hopper 18. The loading of articles into bag 13 thus continues until the cashier notes that the articles contained in bag 13 have reached a level at least proximate the photocell array 61, whereupon the cashier again depresses the starting pushbutton (steps 203 and 204) and, since this is the second time that the pushbutton has been depressed, control passes to step 206. At this point the first apparatus loading platform 148 descends to its lowermost height or level and, if the photocell array 61 remains obscured (step 206), the cashier is informed by a suitable optical and/or acoustic signal (step 207) that the excess articles should be removed from the bag 13. After the cashier has removed the excess articles and the same is confirmed by the photocell array 61 (step 206), the status of the hopper 18' of the second apparatus is determined at step 208 for use in adjusting the operative coordination of the first and second apparatus.

It should be recognized that, at the end of step 206, the second apparatus may have its hopper 18' either open or closed depending, for example, on whether a bag 113 disposed therebelow has already been filled and is in the process of being ejected and replaced with a new bag. If hopper 18' is open then operation proceeds to step 209 at which the cashier can continue to introduce articles into the bag 113 held beneath the hopper 18' while the first apparatus proceeds to eject the full bag 13' (step 210), to dispense and deliver a new bag 13 detached from the continuous strip 12 of reel 11 (step 211), and to open and hold open this new bag (step 212) immediately below the first apparatus hopper 18. Processing then returns to step 202 in which articles may once again be introduced into each of the bags 13, 113 through the respective hoppers 18, 18', the new bag 13 having just been opened and the bag 113 being not yet full.

If, on the other hand, it is detected in step 208 that the second apparatus hopper 18' is closed, the microprocessor or the like which controls the operative coordination of the first and second apparatus stores, at step 213, information denoting the existing condition—namely, that the cashier has pressed the first apparatus starting pushbutton for the second time (step 204), that the photocells 61 are unobstructed or free (step 206), and that the hopper 18' is closed (step 208). Consequently, while the first apparatus has ejected the filled bag 13', and has dispensed, delivered and opened a new bag immediately below the first apparatus hopper 18, the second apparatus hopper 18' has remained closed.

When the cashier sees, through the hopper 18', that the articles contained in the underlying open bag 113 of the second apparatus have substantially reached the level of the photocell array 161 or, similarly, the top of the bag, he or she depresses (for the first time) the starting pushbutton of the second apparatus (step 213). Since this is the first time that the second apparatus starting pushbutton has been actuated in this operating cycle, control passes from step 214 to step 215 at which the second apparatus loading platform 148 is lowered to its intermediate position to enlarge the available interior volume of bag 113 and thereby enable the bag to accomodate additional articles therewithin. Returning then to step 202, purchased articles may continue to be introduced selectively into either or both of the bags 13, 113.

When the articles packed in the open bag 113 have once again substantially reached the level of photocell array 161, the cashier depresses the starting pushbutton of the second apparatus (step 213) for a second time (step 214), the loading platform 148 descends to its lowermost position and control is passed to step 216. If the photocells of array 161 remain obscured after the filling platform has completed its final descent, a signal is sent to the cashier (step 217), requesting removal of the excess articles from within bag 113. This procedure is similar to that which was previously described with respect to the first apparatus at step 207. When the excess articles have thereafter been removed from the bag, the status of the first apparatus hopper 18 is determined at step 218 and, if the hopper 18 is found to be closed, the microprocessor or the like stores this condition information at step 223—i.e. that the second apparatus pushbutton has been depressed for a second time, that the photocells 161 are unobstructed and that the hopper 18 is closed. If, on the other hand, it is determined at step 218 that the hopper 18 is open, the cashier may continue to introduce items into the underlying bag 13 through the hopper 18 (step 219) while the second apparatus automatically ejects the filled bag 113' (step 220), dispenses a new bag 113 and opens and holds open the new bag (step 222) immediately below the second apparatus hopper 18'. The optimum operating condition of the inventive checkout counter, in which both hoppers 18, 18' are concurrently open to permit the introduction of purchased articles selectively into the respectively underlying bags 13, 113, is thereby restored and the loading of the bags may continue (step 202).

As should now be apparent from the preceding description, in accordance with the coordinated operation of the first and second bag feeding apparatus the checkout counter of the invention is always restored to its optimum operating condition in which both hoppers 18, 18' are concurrently open so as to enable the cashier to selectively introduce or deposit articles into either of two open and conveniently located bags. This meets the aforementioned intention that the two hoppers 18, 18' be concurrently open for at least one-half of the time necessary to complete each operating cycle. Moreover, the operative coordination of the first and second bag feeding apparatus assures that during an operating cycle both hoppers 18, 18' are concurrently closed, if at all, for only minimal periods; accordingly, the cashier is able to introduce purchased articles into at least one of the bags 13, 113 on a continuous or substantially continuous basis and need not delay or discontinue the checking of articles while a customer stands or waits at the checkout counter.

While there have been shown and described and pointed out fundamental novel features of the invention as applied to preferred embodiments thereof, it will be understood that various omissions and substitutions and changes in the form and details of the devices illustrated, and in their operation, may be made by those skilled in the art without departing from the spirit of the invention. It is the intention, therefore, to be limited only as indicated by the scope of the claims appended hereto.

What is claimed is:

1. A checkout counter for concurrently providing two flexible bags with handles and lateral pleats disposed in open condition for the selective introduction of articles into the open bags, comprising:

a first and a second hopper through which articles are selectively introducible into flexible bags maintained in open condition below said hoppers;

a first and a second reel, each said reel being formed of a continuous web of successively joined, preformed flexible bags wound about a central core, said bags being arranged along the webs such that the bottom of each bag is frangibly attached to the handles at the top of the next following bag in the web; and a first and a second automated bag feedig apparatus, each operable for dispensing a leading bag from a respective one of the reels, for detaching the leading bag from the continuous web of said one reel, for delivering the detached bag to an article-receiving station disposed immediately below a respective one of the hoppers, for opening the detached bag at the article-receiving station, and for maintaining the detached bag in its open condition at the station for receiving articles introduced through said one hopper for a period sufficient to enable the open bag to be filled with articles, wherein each of said automated bag feeding apparatus comprises:

dispensing and delivering means for dispensing a single, closed, detached leading bag from the respective continuous web to the article receiving station by retracting said continuous web from said leading bag thereby detaching the leading bag from the continuous web, and for delivering the detached leading bag to the article-receiving station so that the top of the leading bag is delivered to the article receiving station prior to the bottom of said bag; and opening and maintaining means at the article-receiving station for opening the leading bag dispensed and singly delivered by said dispensing and delivering means and for maintaining the leading bag in an open condition at the article-receiving station to enable the selective introduction of articles into the open bag, said opening and maintaining means including a pair of opposed and relatively movable grippers operable for grasping opposed sides of the detached leading bag so as to open the bag and then maintain the open condition of the bag as the bag is filled with articles.

2. A checkout counter in accordance with claim 1, wherein said dispensing and delivering means of each said apparatus comprises:

a roller for supporting the continuous web reel;

driving means operable for rotating the roller so as to unwind a longitudinal portion of the continuous web from the reel;

a pair of opposed lower driving belt units for gripping therebetween the continuous web unwound from the reel;

a pair of opposed upper driving belt units for gripping therebetween a leading bag of the web, said upper belt units being disposed in superposed relation to said lower driving units; and bidirectional drive means operable in a first mode for driving said lower belt units in a forward direction for advancing the web and the leading bag thereof toward said upper belt units, and for concurrently driving said upper belt units in a forward direction for advancing the leading bag to the article-receiving station to be there opened and maintained open for the receipt of articles in the bag, and in a second mode for driving said lower belt units in a reverse direction for retracting the web while preventing reverse-direction movement of said upper belt units, the leading bag is held stationary by said upper belt units such that the leading bag is frangibly detached from the retracting web for subsequent delivery by the upper belt units to the article-receiving station.

3. A checkout counter in accordance with claim 1, wherein said opening and maintaining means of each said apparatus further comprises:

means for horizontally reciprocating said grippers between a first position spacing apart said grippers and at which the grippers grasp the opposed sides of the detached leading bag to hold and maintain the bag in its open condition, and a second position wherein said grippers are in mutual proximity and at which the grippers operably grasp the opposed sides of the closed leading bag which has been advanced to the article-receiving station by said dispensing and delivering means and then open the bag as the grippers are returned from their second to their first position; and a pair of flaps pivotally movable between a first, substantially horizontal orientation in which the flaps substantially close the respective one of said first and second hoppers so as to prevent the introduction of articles through the respective hopper to the article-receiving station, and a second, substantially vertical orientation in which the flaps overlie at least portions of said opposed sides of the leading bag being held open at the article-receiving station by said grippers so as to further maintain the open condition of the leading bag for the receipt of articles therewithin.

4. A checkout counter in accordance with claim 1, wherein at least one of said first and second apparatus further comprises means for supporting the leading bag as articles are introduced into the open bag at the article-receiving station, and for ejecting the bag, when the bag is filled with articles, from the apparatus.

5. A checkout counter in accordance with claim 4, wherein the leading bag of each said continuous web has a longitudinal length and said supporting and ejecting means comprises:

a vertically-reciprocatable loading platform for supporting the open leading bag as articles are introduced into the bag through the hopper;

means operable for vertically reciprocating said platform between at least a first raised position in which a longitudinal portion of the leading bag less than the length thereof is initially presented, when the bag is opened by said opening and maintaining means, for the receipt of articles in the open bag, and a second lowered position in which substantially the full length of the open leading bag is presented for the receipt of articles in the bag so that, after the bag has been filled with articles while supported by the platform in said first position of the platform, said platform is lowered by said operable means to said second position to enable the continued introduction of additional articles into the open bag; and a horizontally-reciprocatable ejector for discharging the leading bag from the apparatus after the bag has been filled with articles.

6. A checkout counter in accordance with claim 2, wherein said lower driving belt units of each said apparatus comprise a pair of driving rollers, a pair of lower rollers, a plurality of belts trained for bidirectional movement about said driving and lower rollers and between opposed ones of which the web is engageable for advancing and retracting movement of the web, and lever means connected to one of said lower rollers for selectively displacing said one lower roller from the other of said lower rollers so as to facilitate feeding of a leading end of the continuous web from the reel into a nip defined between said opposed lower belt units.

7. A checkout counter in accordance with claim 6, wherein said lower driving belt units of each said apparatus further comprise an intermediate roller interposed between said driving and lower rollers, and said lever means comprises a lever having a fulcrum at said intermediate roller and about which said lever is pivotable for selectively displacing said one lower roller from the other lower roller.

8. A checkout counter in accordance with claim 2, wherein said upper driving belt units of each apparatus comprise a pair of upper rollers, a superposed pair of idler rollers, and a plurality of drive belts trained about the upper and idler rollers.

9. A checkout counter in accordance with claim 2, wherein said lower driving belt units of each said apparatus include a pair of driving rollers and said upper driving belt units of each said apparatus include a pair of upper rollers, and said bidirectional drive means of each said apparatus comprises motor means connected to and operable for rotating one of said upper rollers pair or said driving rollers pair, and a drive chain connecting said upper and driving rollers pairs so as to transfer the rotation of the motor means driving one of said upper and driving roller pairs to the other of said roller pairs.

10. A checkout counter in accordance with claim 9, wherein said dispensing and delivering means of each said apparatus further comprises a plurality of transport belts disposed spanningly between said lower driving belt unit driving rollers and said upper driving belt unit upper rollers for assisting advancing movement of the leading bag on the continuous web bridgingly from said lower belt units to said upper belt units as said lower and upper belt units are driven in said forward direction by said bidirectional drive means.

11. A checkout counter in accordance with claim 6, wherein said lower driving belt units of each said apparatus further comprise a first intermediate roller interposed between said driving and lower rollers and defining a fulcrum about which said lever means is pivotable for selctively displacing said one lower roller from the other lower roller, and a second intermediate roller about which the belts of the two lower driving belt units rotate in opposition for retaining the continuous web between said opposed belts during the transport of the web by and along said lower driving belt units.

12. A checkout counter in accordance with claim 2, each said apparatus further comprising photocell array means located between said lower and upper driving belt units for determining the time at which the operative mode of said bidirectional drive means should be changed, from said first mode in which the web and the leading bag thereon is advanced by the lower and upper belt units to said second mode in which the web is retracted by said lower belt units while the leading bag is held stationary by said upper belt units so as to thereby frangibly detach the leading bag from the web, by detecting passage beyond said photocell array means or the bottom of the leading bag on the continuous web as the web is advanced by said lower belt units.

13. A checkout counter in accordance with claim 5, wherein said loading platform comprises two half-plates separated by an aperture through which the leading bag, detached from the continuous web, is advanced by said upper driving belt units to the article-receiving station at which the detached bag is opened by said grippers.

14. A checkout counter in accordance with claim 5, wherein said ejector comprises a plurality of parallel, horizontally-oriented pickets, and wherein said apparatus further comprises a filled bag discharged opening and a gate located proximate said opening and formed of two doors unidirectionally outwardly pivotable for enabling ejector-driven discharge on a filled bag from the apparatus through said opening, each of said two doors comprising a plurality of parallel, horizontally-oriented pickets in a comb-like arrangement.

15. A checkout counter in accordance with claim 1, wherein said opening and maintaining means of each said apparatus further comprises means for horizontally reciprocating said grippers between a first position spacing apart said grippers and at which the grippers grasp the opposed sides of the leading bag to hold and maintain the bag in its open condition, and a second position wherein said grippers are in mutual proximity and at which the grippers operably grasp the opposed sides of the closed leading bag which has been advanced to the article-receiving station by said dispensing and delivering means and then open the bag as the grippers are returned from their second to their first position, and each said gripper comprising a first arm, a second arm and spring means disposed between said first and second arms for normally urging said first and second arms relatively one against the other with a side of the leading bag held grippingly therebetween, said first arm carrying thereon a plurality of rubberized blocks for facilitating gripping of a bag side, and said second arm having a plurality of recesses defined therein, said recesses being sized and shaped for accommodating said rubberized blocks as said first and second arms are moved relatively one against the other under the urgency of said spring means.

16. A checkout counter in accordance with claim 1, wherein said opening and maintaining means of each said apparatus further comprises:

a pair of flaps pivotally movable between a first, substantially horizontal orientation in which flaps substantially close the hopper so as to prevent the introduction of articles through the hopper to the article-receiving station, and a second, substantially vertical orientation in which the flaps overlie at least protions of said opposed sides of the detached leading bag that is held open at the article-receiving station by said grippers so as to further maintain the open condition of the leading bag for the receipt of articles therewithin; and operating means for moving said flaps between said first and second positions thereof, said operating means comprising a rocking lever disposed for pivotal movement about fulcrum located intermediate its ends and connected at one end of the rocking lever to one of said flaps and at the other end of the rocking lever to the other of said flaps, and an actuator connected to said rocking lever and operable for pivoting said rocking lever and thereby pivotally moving said flaps between said first and second positions of the flaps.

17. A checkout counter in accordance with claim 16, wherein said operating means of each said apparatus further comprises a first hub on said one flap and a first small lever connecting said first hub to said one end of said rocking lever, and a second hub on said other flap and a second small lever connecting said second hub to said other end of the rocking lever.

18. A checkout counter in accordance with claim 5, wherein said supporting and ejecting means further comprises ejector drive means operable for reciprocatably moving said ejector in a first direction for discharging the detached leading bag from the apparatus after the bag has been filled with articles and in a second direction for returning the ejector to its initial position after the filled bag has been discharged, and photocell array means located proximate said hopper for preventing operation of said ejector drive means when the photocell array means is obscured by articles contained in an open bag disposed in the article-receiving station.

19. A checkout counter in accordance with claim 5, wherein said platform is further movable by said operable means to a third position below said second position and from which the filled bag supported on said platform is dischargeable from the apparatus by said ejector.

* * * * *